US008567863B2

(12) United States Patent
Hetzel et al.

(10) Patent No.: US 8,567,863 B2
(45) Date of Patent: Oct. 29, 2013

(54) BACK SUPPORT, ORIENTATION MECHANISM AND METHOD

(75) Inventors: Thomas R. Hetzel, Littleton, CO (US); Rex Stevens, Longmont, CO (US); Bruce D. Roemmich, Steamboat Springs, CO (US); Steven C. Maurus, Littleton, CO (US)

(73) Assignee: Aspen Seating, LLC, Sheridan, CO (US)

( * ) Notice: Subject to any disclaimer, the term of this patent is extended or adjusted under 35 U.S.C. 154(b) by 168 days.

(21) Appl. No.: 13/039,051

(22) Filed: Mar. 2, 2011

(65) Prior Publication Data

US 2012/0223560 A1 Sep. 6, 2012

(51) Int. Cl.
*A47C 7/40* (2006.01)

(52) U.S. Cl.
USPC ..... 297/284.4; 297/354.11; 297/354.12; 297/440.2

(58) Field of Classification Search
USPC ..... 297/440.2, 284.4, 284.5, 354.11, 297/354.12
See application file for complete search history.

(56) References Cited

U.S. PATENT DOCUMENTS

| | | | | |
|---|---|---|---|---|
| 4,615,856 | A | 10/1986 | Silverman | |
| 4,883,320 | A | 11/1989 | Izumida et al. | |
| 5,211,446 | A * | 5/1993 | Jay et al. | 297/440.2 |
| 5,364,162 | A | 11/1994 | Bar et al. | |
| 5,556,168 | A | 9/1996 | Dinsmoor, III et al. | |
| 5,593,211 | A | 1/1997 | Jay et al. | |
| 6,059,370 | A * | 5/2000 | Kanyer et al. | 297/452.36 |
| 6,095,611 | A | 8/2000 | Bar et al. | |
| 6,186,594 | B1 | 2/2001 | Valiquette et al. | |
| 6,257,664 | B1 | 7/2001 | Chew et al. | |
| 6,460,933 | B1 | 10/2002 | Bors et al. | |
| 6,659,563 | B2 | 12/2003 | Float et al. | |
| 6,688,693 | B2 | 2/2004 | Christofferson et al. | |
| 7,104,610 | B2 | 9/2006 | Cramer | |
| 7,216,388 | B2 | 5/2007 | Bieganek et al. | |
| 7,854,481 | B2 | 12/2010 | Fraser | |
| 7,857,394 | B2 | 12/2010 | Whelan et al. | |
| 7,891,739 | B2 | 2/2011 | Cramer | |
| 7,980,580 | B2 | 7/2011 | Loewenthal et al. | |
| 8,070,232 | B2 | 12/2011 | Hung | |

(Continued)

FOREIGN PATENT DOCUMENTS

| | | | |
|---|---|---|---|
| WO | WO 99/17636 | A1 | 4/1999 |
| WO | WO 2009/084961 | A1 | 7/2009 |

OTHER PUBLICATIONS

In the present application, Figures 19-21 and discussion thereof.

(Continued)

*Primary Examiner* — David Dunn
*Assistant Examiner* — Timothy J Brindley
(74) *Attorney, Agent, or Firm* — John R. Ley

(57) ABSTRACT

A back support is pivotally oriented to locate a pivot point relative to posterior superior iliac spines of a seated user, such that when an upper portion of the back support contacts the upper torso of the user and moves to a desired angular orientation to balance the upper torso over the pelvic area, the back support transfers support to the posterior superior iliac spines to maintain the pelvic skeletal structure in alignment. A lower portion of the back support angularly contacts, supports and confines gluteal and buttocks tissue of the user independently of the degree of pivotal orientation of the upper portion.

45 Claims, 22 Drawing Sheets

(56) References Cited

U.S. PATENT DOCUMENTS

| | | | | |
|---|---|---|---|---|
| 8,186,756 | B2 * | 5/2012 | Jorgensen | 297/230.12 |
| 8,197,009 | B2 | 6/2012 | Whelan et al. | |
| 2003/0052525 | A1 | 3/2003 | Bors et al. | |
| 2003/0102706 | A1 | 6/2003 | Float et al. | |
| 2005/0275272 | A1 | 12/2005 | Fraser | |
| 2008/0157581 | A1 | 7/2008 | Whelan et al. | |
| 2010/0276974 | A1 | 11/2010 | Huttenhuis | |
| 2012/0091300 | A1 | 4/2012 | Bee et al. | |

OTHER PUBLICATIONS

PCT International Search Report with attached Written Opinion of the International Searching Authority for International Application No. PCT/US2012/027018, dated Jun. 4, 2012, 8 pages.

* cited by examiner

BACK SUPPORT, ORIENTATION MECHANISM AND METHOD

In general, this invention relates to seating devices and methods, and somewhat more specifically to a mechanism and a method for orienting a back support upon which an upper thoracic area of a user reclines while the user is seated. Even more particularly, the present invention relates to new and improved apparatus and methods for positioning the back support to achieve the best support angle to balance the upper torso of the user without adversely affecting optimal pelvic support and alignment characteristics of the user. The present invention has particular benefits in achieving optimal and safe posture for a user who depends on a wheelchair for mobility.

BACKGROUND OF THE INVENTION

A back support and a seat support should perform many important functions to provide the best benefit to a seated individual. The back and seat supports should be comfortable and encourage proper support for optimal posture and posture control for a considerable length of time. The back and seat supports should also create stability and a sense of secure confinement, thereby avoiding a feeling or tendency of falling or slipping out of the seating device. The security of confinement is particularly important to a wheelchair user. In addition, the back and seat supports should also enhance the functional capabilities of the wheelchair user by supporting independence in activities of daily living.

The seat support plays an important role in obtaining these benefits. The seat support must receive and distribute the weight of the user, while facilitating reasonable movement of the user. Because the seat support resists most of the user's weight, it should prevent and reduce the incidence of localized areas of discomfort and soreness, which in the case of wheelchair users can lead to pressure ulcers and skin shear force abrasions, created by prolonged sitting without adequate pressure relief. Pressure ulcers and shear abrasions can become a serious health problem for wheelchair users who must remain constantly in contact with the seat support.

There are a number of different support contours and configurations, as well as support theories and techniques, for configuring the contour of the seat support. One particularly advantageous configuration is described in U.S. Pat. No. 7,216,388, which is assigned to the assignee of this invention. However and regardless of the type of contour which may be employed, it is essential that the upper leg and pelvic skeletal structure and pelvic tissue of the user interact in a consistent intended way with the contour of seat support. Otherwise, the pelvic area of the user may move into an unintended position, causing distortion of the intended anatomical interaction with the contour of the seat support and diminishing or destroying the benefits desired from the seat support. This particular constraint is particularly critical for wheelchair users who often lack the capability to adjust or move their own position within the seat support and must depend entirely on the contour of the seat support and the back support to maintain the intended orientation and interaction.

The back support must function in conjunction with the seat support to maintain the optimal pelvic alignment. The back support should contact the back of the pelvic area and transfer force to restrain the pelvic area from tilting backward on the seat support. Achieving the desired optimized pelvic alignment is possible only because the back support contacts the pelvic area to hold it in the desired orientation. By itself, the seat support is substantially incapable of preventing the pelvic area of the user from tilting backward. The back support must therefore perform the essential role of maintaining a safe, comfortable, secure and desired pelvic alignment with the seat support.

In addition, the back support should play an additional important role of balancing the upper torso of the user in a comfortable and supportive manner over the pelvic area. The pelvic area is principally responsible for transferring the weight of the upper torso of the user to the seat support, so balancing the weight above the pelvic area is the most effective manner by which to transfer that weight. Without balancing the upper torso of the user above the pelvic area, the user may experience the sensation of the upper torso falling forward or the pelvic area sliding forward off of the seat support. Furthermore, not properly balancing the weight of the upper torso over the pelvic area will create a distortion to the desired alignment and interaction of the pelvic area with the seat support, and over time will diminish or destroy the desired effects of proper pelvic alignment with the seat support, leading to the health and safety concerns described above.

In many circumstances involving previous seating devices, it is impossible to position the back support to maintain proper alignment and orientation of the pelvic area and also orient the back support to balance the weight of the user's upper torso. Adjusting the back support to maintain the optimal orientation of the pelvic area did not permit balancing the weight of the upper torso over the pelvic area, causing the user to experience the sensation of falling forward or sliding forward off of the seat support. Similarly, if the back support was adjusted to balance the weight of the upper torso, the pelvic area was not maintained in the optimal alignment, resulting in an increase in discomfort and fatigue, and in the case of a wheelchair user, possible dangerous pressure ulcers and shear force abrasions, as well as reductions in the desired optimal posture, posture control, support, stability, range of motion, balance, and comfort, among other things. Consequently, it became necessary to compromise one or both of the optimal pelvic alignment or the upper torso orientation.

Attempts have been made in the past to address some of these issues. One particular device employs a back support having a cushion with a contour that projects forward at a location adapted to support the pelvic area while providing a limited range of back support orientation to assist locating the upper torso weight over the pelvic area. Another particular device uses hinges which allows a bottom portion of the back support to pivot relative to an upper portion of the back support, thereby allowing the bottom portion of the back support to interact with the pelvic area while the upper portion of the back support interacts with the upper torso of the user. Both of these prior devices provide greater flexibility in adjusting the position of the upper torso for weight balance over the pelvic area, but both of these prior devices fail to provide the most desirable benefits for interacting with the tissue and skeletal structure of the pelvic area.

SUMMARY OF THE INVENTION

In accordance with the general nature of the present invention, new and improved apparatus and methods provide optimal back support orientation for the upper torso of a seating device user without adversely affecting the optimal pelvic alignment of the user with the back support and seat support. The present invention makes it possible to optimize the orientation of the back support to balance the upper torso over the pelvic area without disturbing or compromising the optimal alignment of the pelvic area, without disturbing or compromising optimal upper torso orientation, pelvic alignment and support of posterior superior iliac spines of the pelvic skeletal structure of the user. Further still, the present invention makes it possible to obtain a better degree of comfort, support, confinement and stability around the tissue of the pelvic area, while still obtaining the optimized benefits of alignment and orientation of the pelvic area and upper torso. As a consequence of the present invention, it is no longer necessary to compromise one or both of the optimal pelvic alignment or the upper torso orientation, thereby obtaining optimum improvements in posture, control, support, stability, range of motion, balance, maneuverability and comfort, among other things, for the user of a seating device such as a wheelchair.

One inventive aspect described herein relates to an apparatus and method for supporting a back support from of a frame of a seating device, such as canes of a wheelchair. The back support contacts an upper torso and supports posterior superior iliac spines of a pelvic skeletal structure of a user while seated on a seat support. Under these circumstances, gluteal and buttocks tissue of the user is located above a rear portion of the seat support. In one regard of this inventive aspect, a substantially rigid back shell orients and retains the back support to contact and support the upper torso of the user while simultaneously maintaining support on the posterior superior iliac spines independently of the angular orientation of the back shell and upper torso. A back support orientation mechanism is operatively connected between the back shell and the frame to position and orient the back shell. The back support orientation mechanism pivots the back shell about a pivot point. A lower edge of the back shell is located below an alignment reference extending between the pivot point and posterior superior iliac spines when the user is seated on the seat support and above a substantial majority of the gluteal and buttocks tissue. In another regard of this inventive aspect, the upper torso of the user is supported within the upper portion of the back support, the posterior superior iliac spines are supported with a lower marginal area of the back support to maintain a desired alignment of the pelvic structure with the user seated on the seat support, the back support is pivoted about a pivot point to change the angular orientation of the upper portion of the back support and the upper torso without substantially changing the support on the posterior superior iliac spines by the lower marginal area of the upper portion of the back support, the lower marginal area of the upper portion of the back support is positioned below a reference extending between the pivot point and the posterior superior iliac spines and above a substantial majority of the gluteal and buttocks tissue when the user is seated on the seat support, and the lower portion of the back support is angularly extended at a predetermined angle relative to the upper portion of the back support to contact and support the gluteal buttocks tissue below the posterior superior iliac spines. In these regards, the lower edge of the back shell and lower marginal area of the back support is limited to a location no lower than is necessary to transfer support through the back support cushion to the posterior superior iliac spines. Consequently, optimal orientation and alignment conditions are obtained from both the back support and the seat support.

Another inventive aspect relates to a mechanism and method for orienting a back shell from a frame of a seating device, such as canes of a wheelchair. In regard to this inventive aspect, an attachment bracket is connectable to the frame; an attachment assembly is connectable to the back shell; and an adjustment assembly is operative between the cane bracket and the attachment assembly to permit independently adjustable movement and retention of the attachment assembly relative to the attachment bracket in forward and backward directions, in upward and downward directions and in forward and backward pivotal directions independently of any movement and retention in any of the other directions. The upper torso of the user can be oriented at an optimal and desired angle to balance the weight on the pelvic skeletal structure of the user seated on the seat support, without disturbing the proper and safe supportive relationship of the posterior superior iliac spines with the back support, while eliminating forces which make the upper torso feel as though it is falling forward or the pelvic area is sliding forward on the seat support.

An additional inventive aspect relates to a back support cushion and a method of forming a back support cushion. The back support cushion supports an upper torso and gluteal and buttocks tissue of a user, for example a wheelchair user, when seated on a seat support of a seating device, for example a wheelchair. The seating device has a back shell that is oriented for retaining and orienting the back support cushion to contact an upper torso of the user without substantially disturbing the desired interaction and support of the posterior superior iliac spines by a lower portion of the seat support cushion. An upper portion of the back support cushion is retained by the back shell to contact the upper torso of the user and the posterior superior iliac spines; a lower portion of the seat support cushion extends from the upper portion and below the back shell to contact and support the gluteal and buttocks tissue of the user. At least one brace member extends between the upper and lower portions to retain the lower portion in supportive contact with the gluteal and buttocks tissue of the user. The brace member resists changes in orientation of the lower and upper portions of the back support cushion with respect to one another.

A further inventive aspect involves a method of fitting a back support cushion to an upper torso of a user of a seating device, for example a wheelchair, without adversely affecting support of posterior superior iliac spines of a pelvic skeletal structure of the user when seated on the seat support. The inventive method involves attaching a back shell to the frame, for example canes of a wheelchair, to pivot about a pivot point; adjusting a vertical position of the back shell to position a lower edge of the back shell below an alignment reference extending between the pivot point and posterior superior iliac spines and above a substantial majority of the gluteal and buttocks tissue of the user when seated on the seat support; adjusting a pivoted orientation of the back shell about the pivot point to extend the back shell at an angular orientation for balancing the weight of the upper torso over the pelvic skeletal structure without inducing forces on the posterior superior iliac spines that push the pelvic area forward or induce the upper torso to fall forward; temporarily attaching at least one elongated stay to the back shell, each stay having an upper part adjoining the back shell and a lower part extending below the lower edge of the back shell, the temporary attachment of each stay to the back shell replicating a position of the upper part of each stay within the back support cushion when the back support cushion is retained against the back shell; adjusting an angle of the lower part of each stay relative to the upper part of each stay to align the lower part of each stay to contact and support the gluteal and buttocks tissue below the lower edge of the adjusted height back shell while the upper torso extends at the adjusted pivot orientation of the back shell, the lower part of each stay angled relative to the upper part of each stay supporting and confining the gluteal and buttocks tissue when the user is seated on the seat support; disconnecting each temporarily attached stay from the back shell; assembling each disconnected stay into the back support cushion to occupy substantially the same position relative to the back shell when the assembled back support cushion is retained by the back shell that each stay occupied when temporarily attached to the back shell; and retaining the assembled back support cushion against the back shell.

Additional subsidiary aspects of this inventive method of fitting the back support cushion involve temporarily attaching a flexible contour platform relative to the back shell with the back shell adjusted to the pivot orientation, the temporary attachment of the contour platform replicating a position of the contour platform relative to each stay within the back support cushion when the back support cushion is retained against the back shell; and disconnecting the temporarily attached contour platform from the back shell and assembling the disconnected contour platform into the back support cushion to occupy substantially the same position within the assembled seat support cushion that the contour platform occupied when temporarily attached relative to the back shell. Another subsidiary aspect involves attaching pelvic support wedges to the temporarily attached contour platform at positions adjacent to the back shell to provide support for the iliac crests of the pelvic skeletal structure from the pelvic support wedges when the user is seated on the seat support; disconnecting the temporarily attached contour platform from the back shell after the pelvic support wedges have been attached to the contour platform; and assembling the disconnected contour platform with the attached pelvic support wedges into the back support cushion to occupy substantially the same positions that the contour platform and pelvic support wedges occupied when the contour platform was temporarily attached relative to the back shell.

The inventive aspects are described specifically in the appended claims. A more complete appreciation of the inventive aspects and their scope, as well as the manner in which they obtain improvements and other benefits, can be better appreciated by reference to the following detailed description of presently preferred embodiments and the accompanying drawings, which are briefly summarized below.

BRIEF DESCRIPTION OF THE DRAWINGS

FIG. 9A illustrates the attachment assembly in a closed and locked position, FIG. 9B shows the attachment assembly in a open and unlocked position, and FIG. 9C shows the attachment assembly in FIG. 9A from an opposite side.

FIG. 12 is a perspective view of the wheelchair shown in FIGS. 1 and 2, showing establishing a height of the back shell relative to a posterior superior iliac spine of the pelvic skeletal structure of the user and the desired relationship between the posterior superior iliac spine; FIG. 13 is a perspective view showing establishing a pivot orientation of the back shell to balance the upper torso of the user, and placing support stays of the back support cushion on the back shell; FIG. 14 is a perspective view similar to FIG. 13 to which a contour adjustment platform of the back support cushion is attached; FIG. 15 is a perspective view similar to FIG. 14, to which wedge supports have been attached to maintain the desired postural alignment between the pelvic area and the upper torso of the user; FIG. 16 is a perspective view similar to FIG. 13, showing the stays after they have been bent to supportively contact the gluteal or buttocks tissue of the user.

DETAILED DESCRIPTION

Figure 1A:
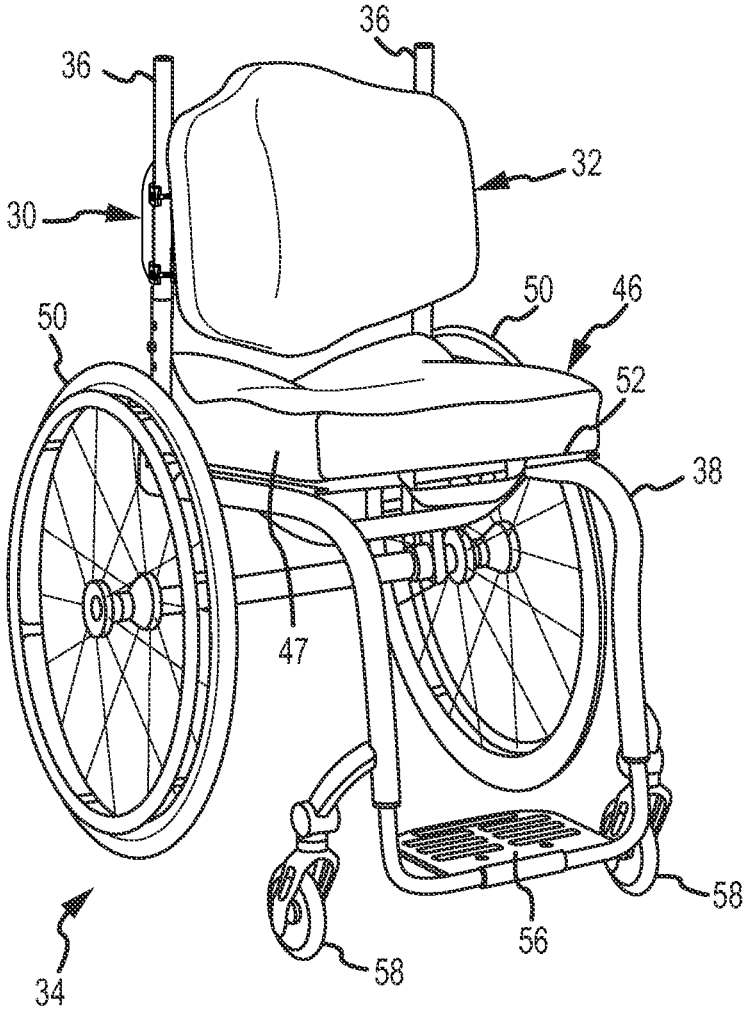
FIG. 1A is a front perspective view of a wheelchair which incorporates the present invention.
Figure 1B:
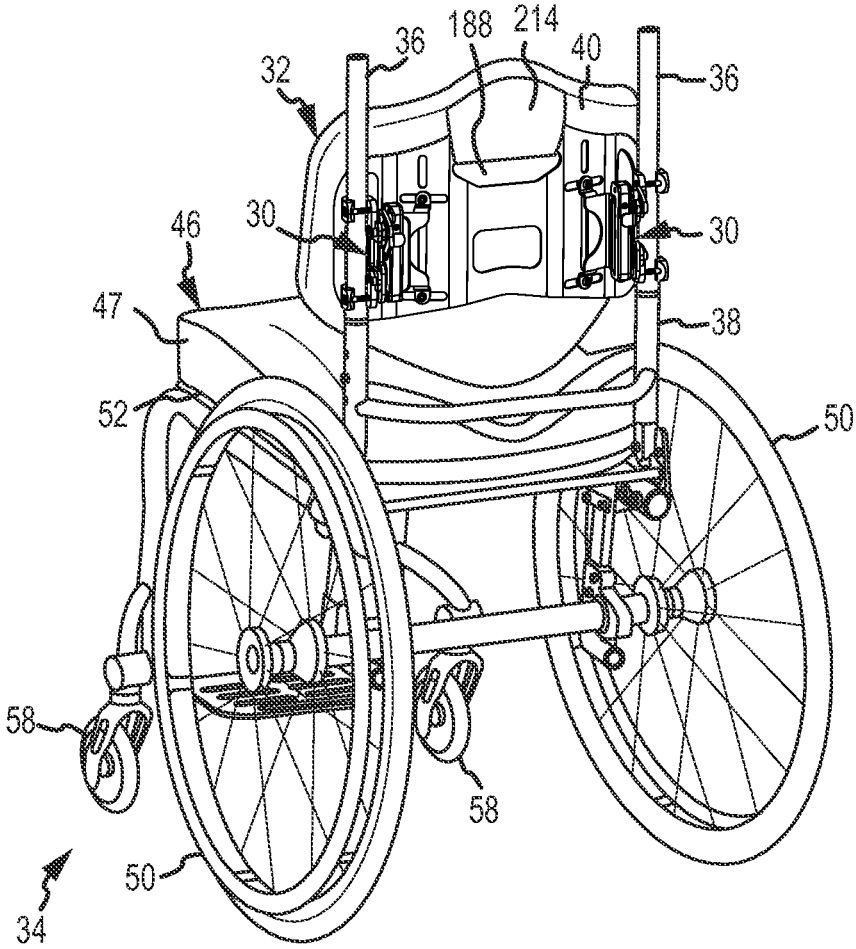
FIG. 1B is a rear perspective view of the wheelchair shown in FIG. 1A, showing details of a back support orientation mechanism which incorporates one aspect of the present invention.

A back support orientation mechanism 30 and a back support 32 used with a wheelchair 34 are shown in FIGS. 1A and 1B. The back support orientation mechanism 30 is attached between upright posts or canes 36 of a frame 38 of the wheelchair 34 and a back shell 40. The back shell 40 retains a back support cushion 41. The back shell 40 constitutes one part of the back support 32, and the back support cushion 41 constitutes another part of the back support 32. The back shell 40 and the retained back support cushion 41 are adjustable in position by functional features of the orientation mechanism 30.

The wheelchair 34 is one example of a seating device to which the present invention may be applied. Using the present invention in connection with the wheelchair 34 provides many significant improvements in the field of wheelchairs and support for users of wheelchairs, but the invention may be applied in other different applications and devices in which an individual is seated.

Figure 2:
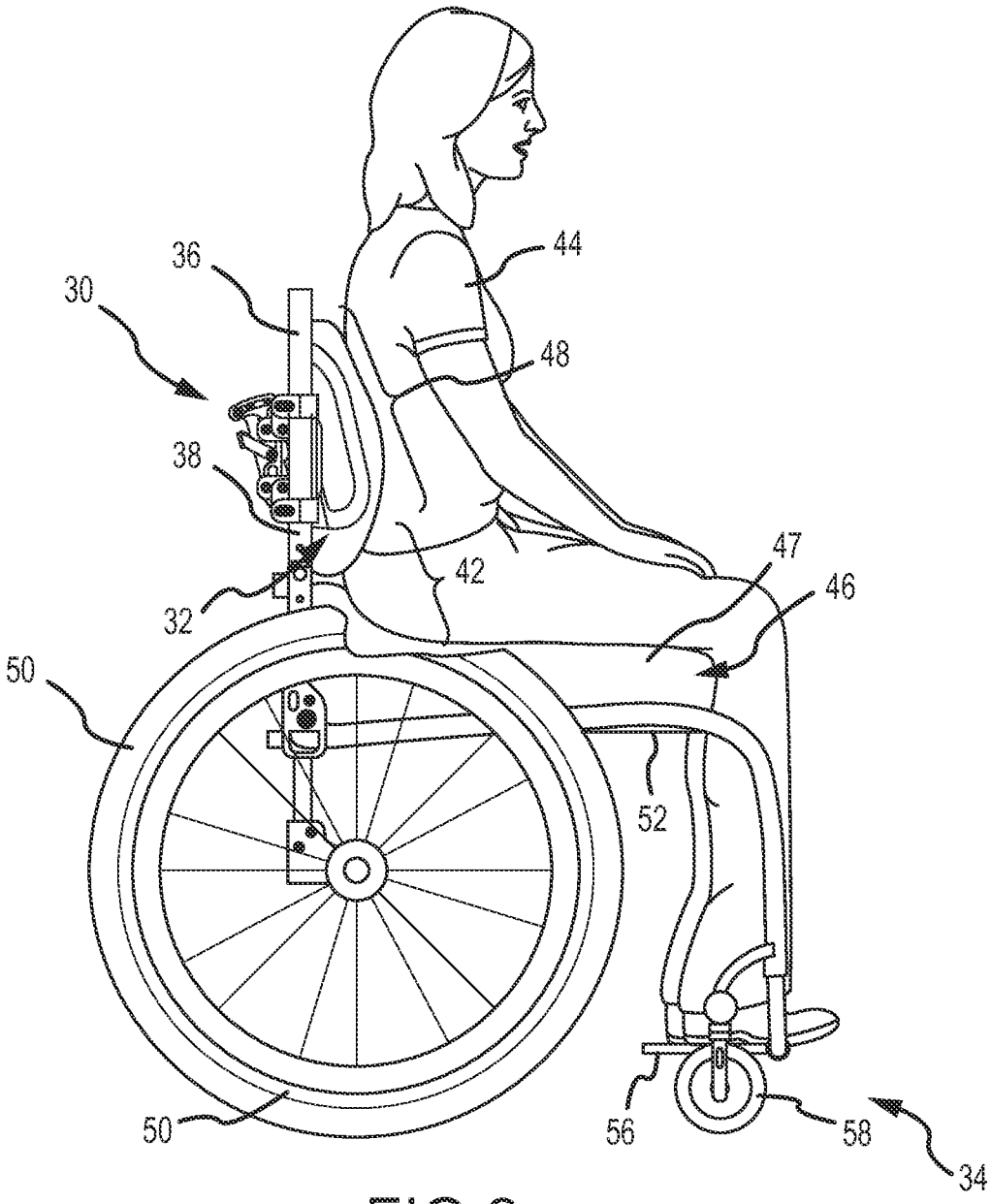
FIG. 2 is a side elevation view of the wheelchair shown in FIGS. 1A and 1B, upon which a wheelchair user is seated.

As shown in FIGS. 1A, 1B and 2, a pelvic area 42 and a pelvic skeletal structure 43 (FIGS. 3A and 3B) of a wheelchair user 44 contact and interact with the back support 32 and a seat support 46 of the wheelchair 34. The seat support 46 comprises a seat support cushion 47 and a horizontal platform 54 connected to the frame 38 of the wheelchair 34. The horizontal platform 54 supports the seat support cushion 47 in a manner to allow the user 42 to rest upon the seat support cushion 47. Depending upon the support contour of the seat support cushion 47 and the desired interaction between the characteristics of the seat support cushion 47 and the pelvic skeletal structure 43, the weight of the user 44 may rest primarily upon the ischial tuberosities 49 of the pelvic skeletal structure 43, or the weight may rest principally on hip joints 51 where thigh bones 53 connect to sockets formed in illums 55 of the pelvic skeletal structure 43. In this latter circumstance, which is described more completely in U.S. Pat. No. 7,216,388, the ischial tuberosities 49 do not contact the seat support cushion 47 with any substantial weight-bearing force.

In accordance with different aspects of the invention, all of which are described in greater detail below, the pelvic area 42 and pelvic skeletal structure 43 (FIGS. 3A and 3B) is maintained against adverse misalignment and backward tilting by the back support 32 while an upper torso 48 of the user 44 is oriented to balance the weight of the upper torso 48 over the pelvic area 42 of the user 44 without disturbing the optimal alignment of the pelvic area 42. A lower edge 186 (FIGS. 4 and 10) of the back shell 40 is fixed in position at a height no lower than is necessary to transfer support to posterior superior iliac spines 57 and illiac crests 61 of the pelvic skeletal structure 43 (FIGS. 3A and 3B) to maintain the optimal alignment of the pelvic skeletal structure 43. A relatively more flexible lower portion of the back support cushion 41 extends below the lower edge 186 of the relatively more rigid back shell 40 and is adjustable relative to an upper portion of the back support cushion 41 which is adjacent to and retained by the back shell 40. The adjustment of the lower portion of the back support cushion 41 with respect to the upper portion allows the lower portion to support, to confine and to provide stability to the substantial majority of the gluteal and buttocks tissue 236 (FIGS. 17 and 18) below the lower edge 186 of the back shell 40. An independent angular, horizontal and vertical positioning capability of the back support orientation mechanism 30 allows the angular orientation of the back support 32 to be adjusted to optimally balance the weight of the upper torso 48 without disturbing the support of the back shell 32 on the pelvic area to maintain the desired pelvic alignment. The back support 32 is fitted to the specific anatomy of the wheelchair user by using and adjusting certain components within the back support cushion 41. As a result, optimal anatomical interaction of the back support 32 and the seat support 46 with the pelvic area 42 are obtained without the need to compromise either interaction. These and other improvements of the invention are described in greater detail below.

The wheelchair 34 is conventional. Two drive wheels 50 are attached to the wheelchair frame 38. The user 44 rotates the drive wheels to maneuver the wheelchair 34. A generally horizontal platform 54 is part of the wheelchair frame 32 to locate and support the seat support cushion 47. A foot rest 56 extends downward at the forward edge of the platform 54 to support the feet of the wheelchair user. Casters 58 extend from the foot rest support in front of the drive wheels 50 to provide the stability of a four-wheeled vehicle, since the center weight point of the wheelchair user 44 is located in front of the center of the drive wheels 50 and behind the casters 58.

Figure 8A:
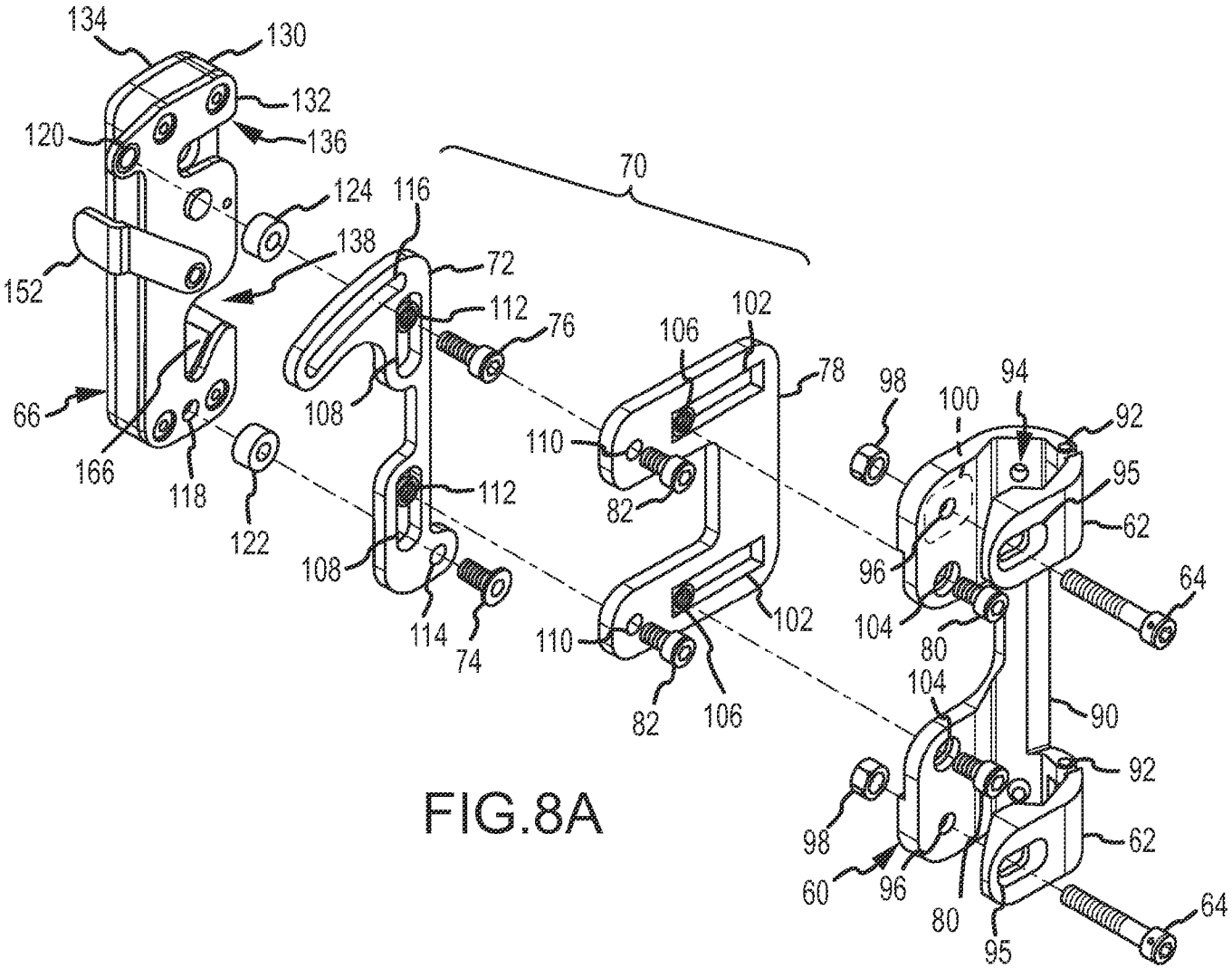
FIG. 8A is an exploded perspective view of components of the back support orientation mechanism shown in FIGS. 4-7B.

One back support orientation mechanism 30 is attached to each of the canes 36. The canes 36 extend upward from opposite lateral sides of the wheelchair frame 38, as shown in FIGS. 2, 3 and 4. The position of each back support orientation mechanism 30 on each cane 36 is independently adjustable. A cane attachment bracket 60 of each orientation mechanism 30 is connected to each cane 36 by a pair of hinge clamp arms 62, as is also shown in FIG. 8A. Retention devices such as bolts 64 are tightened to move the hinge clamp arms 62 toward the cane adjustment bracket 60 and constrict against the canes 36, thereby immovably holding each orientation mechanism 30 in position on one of the canes 36.

A latch assembly 66 of each back support orientation mechanism 30 is connected to a back shell attachment bracket 68, and the back shell attachment bracket 68 is connected to the back shell 40, as shown in FIG. 4. An adjustment assembly 70 of the orientation mechanism 30 (also shown in FIG. 8A), allows the back shell 40 to pivot to forward and backward angular orientations, to move horizontally forward and backward, and to move vertically upward and downward. Each of these three types of movement, forward and backward, upward and downward and forward and backward pivoting, are achievable independently of the other type of movement. This versatile independent movement allows precise positioning of the back support 32, i.e. the back support cushion 47 retained by the back shell 40, to achieve the optimal support of the posterior-lateral pelvic area 42 and upper torso 48.

Figure 5C:
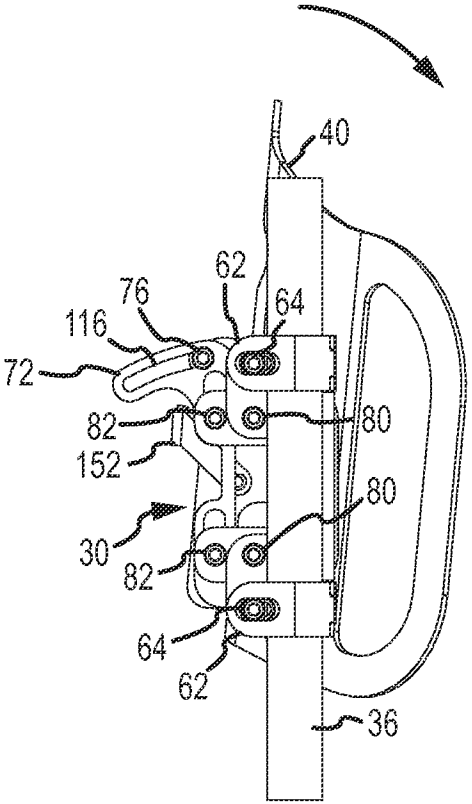
FIGS. 5A, 5B and 5C are side elevational views of the back support orientation mechanism and the back shell shown in FIG. 4, with portions broken away, and respectively illustrating a maximum rearward pivot orientation of the back shell, a neutral vertical pivot orientation of the back shell, and a forward pivot orientation of the back shell, achieved by the back support orientation mechanism.
Figure 5B:
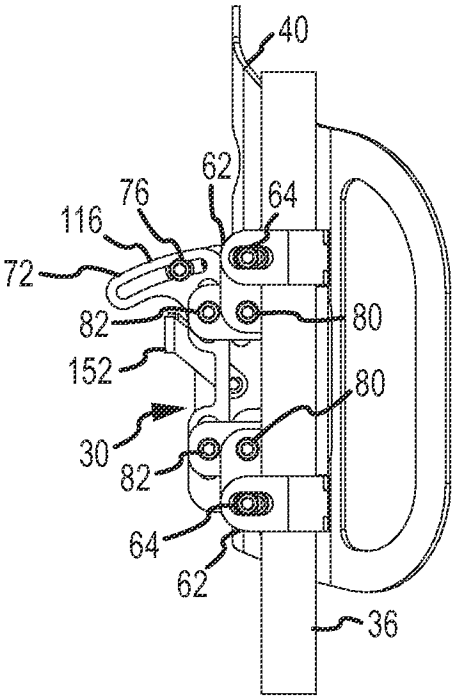
Figure 5A:
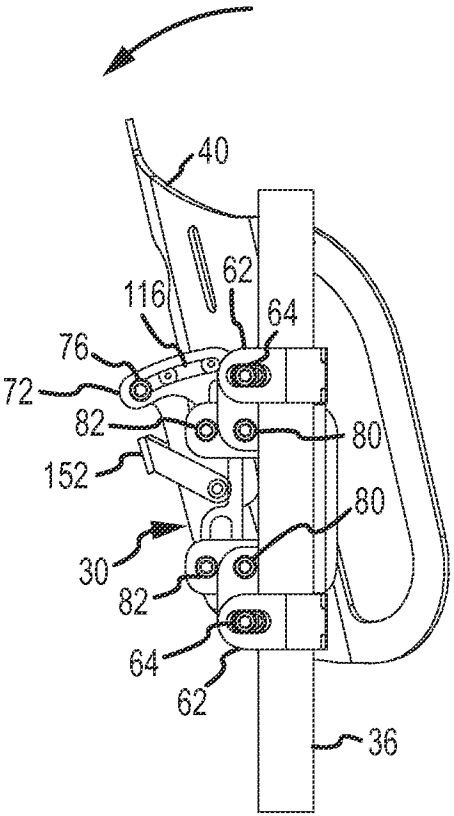

The forward and backward pivoting movement available from the adjustment assembly 70 of the back support orientation mechanism 30, is shown in FIGS. 5A, 5B, 5C and 8A. The adjustment assembly 70 includes an angle adjust bracket 72. The latch assembly 66 is pivotable relative to the angle adjust bracket 72 about a pivot pin or bolt 74. FIG. 5A shows the back shell 40 pivoted to a maximum rearward reclined or backward orientation (approximately 15° behind the cane 36, for example). A retention device or bolt 76 extends between the angle adjust bracket 72 and the latch assembly 66 to maintain the desired pivoted orientation when the bolt 76 is tightened. FIG. 5B shows the back shell 40 pivoted to a neutral or vertical orientation (parallel to the cane 36). This vertical orientation is achieved by pivoting the latch assembly 66 relative to the angle adjustment bracket 72, while the retention bolt 76 is loosened. This position is maintained when the retention bolt 76 is tightened. FIG. 5C shows the back shell 40 pivoted to a maximum forward inclined or forward orientation (approximately 5° in front of the cane 36, for example). This forward pivoted orientation is achieved by pivoting the latch assembly 66 relative to the angle adjust bracket 72 while the retention bolt 76 is loosened, and then tightened to maintain this position. Of course, the back shell 40 may be pivoted to any angular orientation within the range between the maximum rearward reclined orientation (FIG. 5A) and the maximum forward inclined orientation (FIG. 5C), according to the anatomical needs and requirements of the user. The pivoted angular orientation of the back shell 40 is achieved independently of any necessity to adjust or otherwise change the horizontal forward and backward or vertical upward and downward adjustment of the adjustment assembly 70.

Figure 6A:
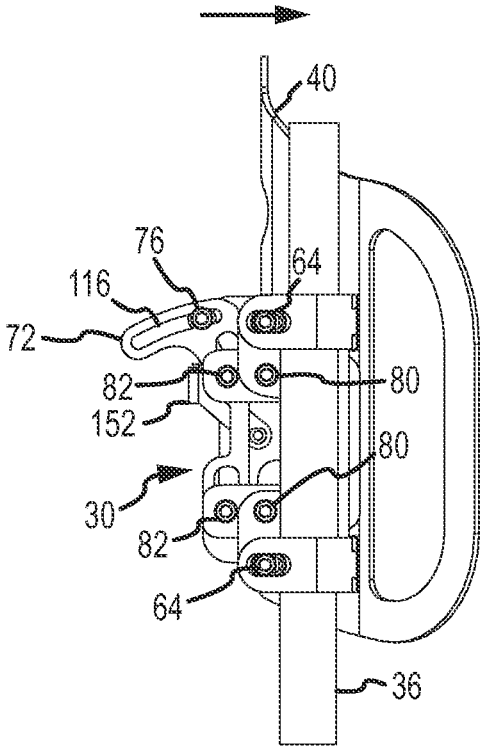
FIGS. 6A and 6B are side elevation views of the back support orientation mechanism and the back shell shown in FIG. 4, respectively illustrating a maximum rearward position of the back shell and a maximum forward position of the back shell, achieved by the back support orientation mechanism.
Figure 6B:
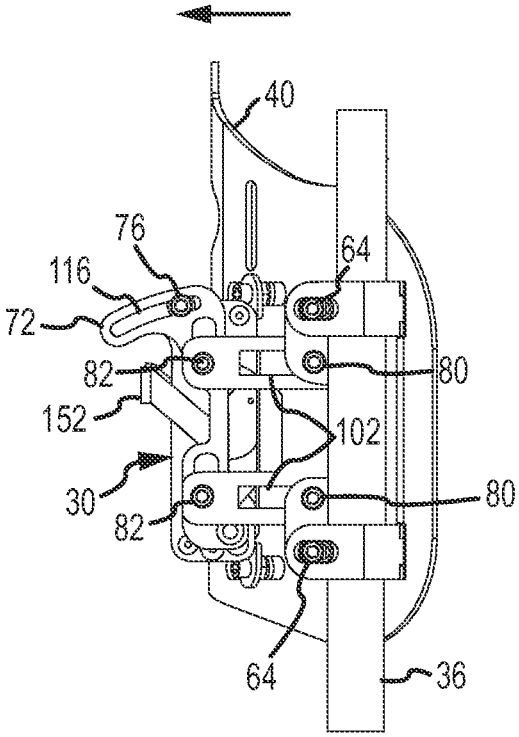

Movement of the back shell 40 horizontally forward and backward is also accomplished by the adjustment assembly 70 of the back support orientation mechanism 30, as shown in FIGS. 6A, 6B and 8A. A depth adjustment bracket 78 of the adjustment assembly 70 is movable forward and backward relative to the cane attachment bracket 60, by loosening and tightening retention devices or bolts 80. Forward and backward movement of the depth adjustment bracket 78 causes corresponding forward and backward movement of the angle adjust bracket 72 and the pivotally connected latch assembly 66. FIG. 6A shows the position of the depth adjustment bracket 80 when positioning the back shell 40 at a forwardmost position, while FIG. 6B shows the position of the depth adjustment bracket 78 when positioning the back shell 40 at a rearwardmost position. The forward and backward adjustment capability of the adjustment assembly 70 is achieved independently of any necessity to adjust or otherwise change the forward and backward pivoting or vertical upward and downward adjustment of the adjustment assembly 70.

Figure 7A:
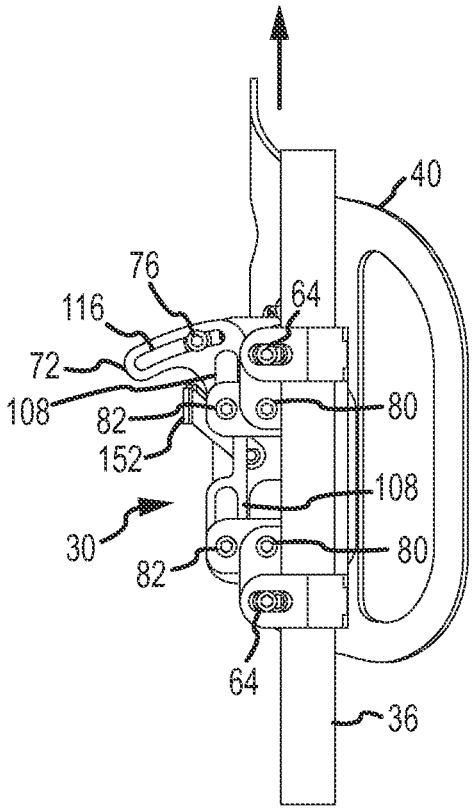
FIGS. 7A and 7B are side elevational views of the back support orientation mechanism and the back shell shown in FIG. 4, respectively illustrating a maximum upward position of the back shell and a maximum downward position of the back shell, achieved by the back support orientation mechanism.
Figure 7B:
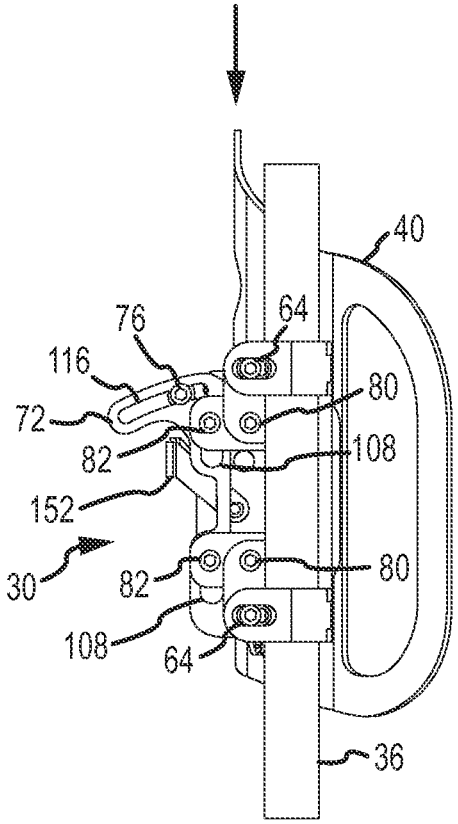

Movement of the back shell vertically upward and downward is also accomplished by the adjustment assembly 70 of the back support orientation mechanism 30 as shown in FIGS. 7A, 7B and 8A. The angle adjust bracket 72 is movable upward and downward relative to the depth adjustment bracket 78 by loosening and tightening retention devices or bolts 82. Upward and downward movement of the angle adjust bracket 72 causes the pivotally-connected latch assembly 66 to move vertically in conjunction with the angle adjust bracket 72. FIG. 7A shows the position of the angle adjust bracket 72 relative to the depth adjustment bracket 78 when positioning the back shell 40 in an uppermost position, and FIG. 7B shows the position of the angle adjust bracket 72 relative to the depth adjustment bracket 78 when positioning the back shell 40 in a lowermost position. The vertical upward or downward positioning is achieved independently of any necessity to adjust or otherwise change the forward and backward pivoted angular adjustment or the vertical upward and downward adjustment of the adjustment assembly 70.

The vertical upward and downward movement of the angle adjust bracket 72 relative to the depth adjustment bracket 78 is intended to finely position the height of the back shell 40 relative to the skeletal structure of the wheelchair user. More significant changes in the upward and downward position are achieved by repositioning the location of the cane attachment bracket 60 on the canes 36.

Further refinements in positioning the back shell 40 according to the anatomical requirements of the wheelchair user are achieved by independently adjusting each back support orientation mechanism 30 relative to the other orientation mechanism 30 connected on the opposite side of the back shell 40. Each orientation mechanism 30 can be attached at a different height on its cane 36. Each orientation mechanism 30 can pivot to a degree different from the other orientation mechanism 30. Each of the orientation mechanisms 30 can move forward or rearward to a different position than the other orientation mechanism 30 is moved. Each orientation mechanism 30 can move upward and downward relative to the other orientation mechanism 30. These relatively different pivoting, horizontal and vertical positions are achievable through the attachment of back shell adjustment bracket 68 to the back shell 40, by using upper and lower slots 84 and 86 formed in the back shell 40 (FIG. 4). Furthermore, although the back shell 40 is substantially rigid, it is not so rigid as to prevent slight torsional rotation from one side to the other side between the back shell attachment brackets 68, as would occur when one of the back support orientation mechanisms 30 is pivoted forward or backward to a greater degree than the other back support orientation mechanism 30 is pivoted.

The ability to achieve a high degree of individualized adjustment in position of the back shell is particularly important in achieving proper and safe seating posture, particularly for wheelchair users who have physical disabilities and associated posture and postural control impairments such as those typically caused by congenital disorders, as well as for other wheelchair users who have a more typical size and shape but have been disabled by acquired or traumatic injuries. In all cases, the back support cushion can be adjusted to safely and securely support and balance the weight of the upper torso 48 above the pelvic area 42 without disturbing or otherwise compromising the optimal pelvic support from the back support 32 and the seat support 46.

The adjustability and variation of the back support 32 made possible by the back support orientation mechanism 30, as shown in FIGS. 5A to 7B, obtains a range of positions and orientations which assure a proper fit for good seating posture. Obtaining the necessary precision in position and orientation is greatly facilitated by the ability to individually adjust each of the vertical, horizontal and pivot orientation directions of the back shell 40 independently of the position and adjustment in the other directions. As a consequence of the seat back orientation mechanism 30, the vertically upward and downward, horizontally forward and backward, and forward and backward pivotal orientations are established without adversely affecting the other positions and angular orientation. In contrast, previous known devices permit adjustments in position and angular orientation, but those adjustments are not independent of one another. Consequently, changing one position or orientation also influenced another position and orientation, making it very difficult and time-consuming to achieve an optimal fit for safe, secure and good posture.

A more complete understanding of the functionality and mechanical details of the back support orientation mechanism 30 is available from the following description taken in conjunction with FIGS. 4, 8A, 8B, 9A, 9B and 9C.

The cane attachment bracket 60, the depth adjustment bracket 78, the angle adjust bracket 72 and the latch assembly 66 of the back support orientation mechanism 30 are shown in separated spatial relationship with respect to one another in FIG. 8A. The terms "inward facing" or "outward facing" are used in the following description of each orientation mechanism 30 refer to physical aspects which are oriented toward or away from a center position of the back shell 40, respectively (FIG. 4), when each back support orientation mechanism 30 is attached to the back shell 40. Thus, the reference to "outward facing" is toward the right direction as shown in FIG. 8A, and the reference to "inward facing" is toward the left direction as shown in FIG. 8A.

The cane attachment bracket 60 secures the back support orientation mechanism 30 to the cane 36 by a clamp body portion 90 which is located at the opposite upper and lower ends of the cane attachment bracket 60 and by the hinge clamp arms 62 which are pivotally connected at hinge pins 92 to each clamp body portion 90. Each hinge clamp arm 62 pivots about the hinge pin 92 with respect to the clamp body portion 90. Each hinge clamp arm 62 is retained around the cane 36 (FIGS. 4 and 11A) by the pivoting movement caused by tightening the retention bolt 64. The clamp body portion 90 and the hinge clamp arms 62 together define multiple sides of a vertical multi-sided conduit 94 in which the cane 36 is received. The sides of the conduit 94 make good retentive contact with the circular cross-section canes 36, but the multi-sided configuration also has the advantage of making good retentive contact with canes having other types of geometric cross-sections (not shown).

Elongated slots 95 are formed in each hinge clamp arm 62 to align with holes 96 formed in the clamp body portions 90 when the clamp arms 62 are in a closed clamping position (FIG. 4). Each retention bolt 64 is inserted through one slot 95 and hole 96 and then secured in place by screwing the retention bolt 64 into a nut 98. The elongated aspect of the bolt slot 94 eliminates binding between the hinge clamp arm 62 and the retention bolt 64 which might otherwise occur when the hinge clamp arm is pivoted when tightening the retention bolt 64 and drawing the hinge clamp arm 62 toward the clamp body portion 90. A parallel sided recess 100 (FIG. 9C) is formed in the inward facing side of the clamp body portion 90 at each hole 96. Flat sides of the nut 98 contact the parallel sides of the recess 100 to retain the nut 98 against rotation when tightening the retention bolt 64.

Each cane attachment bracket 60 is attached to one cane 36 by opening the hinge clamp arms 62, positioning the cane attachment bracket 60 with the clamp body portions 90 adjacent to the canes 36, pivoting the hinge clamp arms 62 to a closed position adjacent to the clamp body portions 90, and then tightening the retention bolts 64 to retain the attachment bracket 60 squeezed against the cane 36 between the pivoting hinge clamp arms 62 and the clamp body portions 90. In addition, the cane attachment bracket 60 may be positioned along the cane 36 by loosening the retention bolts 64 and moving the cane attachment bracket 60 along the cane 36 through the multi-sided conduit 94 until a desired position is reached, and then tightening the retention bolts 64. The procedure of adjusting the position of the cane attachment brackets 60 along the length of the canes 36, after loosening the retention bolt 64, establishes an initial vertical position of the back shell 40 relative to the pelvis and upper torso 48 of the user 44.

Figure 8B:
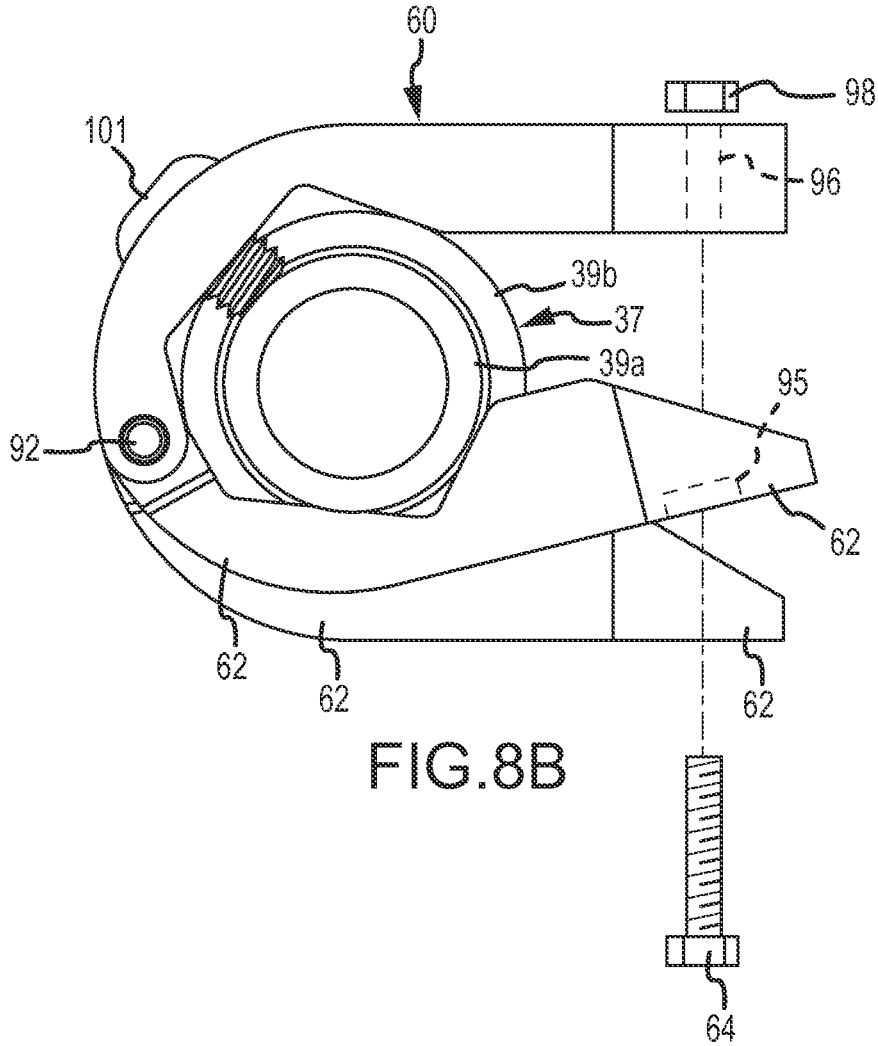
FIG. 8B is a transverse sectional view of the back support orientation mechanism shown in FIG. 8A connected to a cane of a wheelchair frame having telescoping components.

An adjustable set screw 101 is used to finely position the lateral orientation of the multi-sided conduit 94 through the upper clamp body portion 90 and hinged clamp arm 62 in the situation where the cane attachment bracket 60 spans over a changed diameter portion 39*a* and 39*b* of a telescopic cane 37, as shown in FIG. 8B. The set screw 101 is positioned in the top portion of the clamp body portion 90 opposite from the contact points of two surfaces of the upper hinged clamp arm 62. Telescopic canes 37 are sometimes used on wheel chairs in place of constant diameter, single-tube canes 36 (FIG. 4) to adjust the vertical height of seat backs that do not otherwise have a separate vertical adjustment capability. Each telescopic cane 37 includes an upper cane portion 39*a* having a relative small diameter which is inserted into a hollow lower cane portion 39*b* having a relatively large diameter. The upper cane portion 39*a* is vertically moved relative to the lower cane portion 39*b* to change the overall height of the telescopic cane 37.

In the situation where the desired location for the cane attachment bracket 60 spans the changed diameter point of the cane portions 39*a* and 39*b*, the cane attachment bracket 60 is maintained in a lateral orientation surrounding both different-diameter cane portions 39*a* and 39*b* by adjusting the set screw 101 to contact the upper cane portion 39*a* and prevent it from contacting the side of the multi-sided conduit 94 opposite from the hinged clamp arm 62. The set screw 101 then maintains the vertical orientation of the multi-sided conduit 94 parallel to both telescopic cane portions 39*a* and 39*b*, thereby preventing loss of the vertical orientation of the cane attachment bracket 60 which could cause binding of the back support orientation mechanism 30.

The depth adjustment brackets 78 allow for the horizontal adjustment of the back shell 40 relative to the canes 36 or 37 between the forward-most position of the back shell (FIG. 6A) and the rearward-most position (FIG. 6B). Each depth adjustment bracket 78 is C-shaped as shown in FIG. 8A and includes a pair of vertically spaced apart horizontal slots 102. The horizontal slots 102 align with holes 104 formed in the cane adjustment bracket 60. The depth adjustment bracket 78 is secured to the cane attachment bracket 60 by aligning the holes 104 and the slots 102, inserting a flange nut 106 in each slot 102 with the flange portion of the nut 106 contacting the inward facing side of the depth adjustment bracket 78, inserting the retention bolts 80 through the holes 104 and horizontal slots 102 from the outward facing side of the cane attachment bracket 60, and tightening the retention bolts 80 onto the flange nuts 106. The flat sides of the nut portion of the flange nut 106 contact the inner parallel sides of each slot 102 to prevent each nut 106 from rotating when the retention bolt 80 is tightened. The flange portion of each flange nut 106 holds it in place within the horizontal slot 102 and prevents the nut from passing through the horizontal slot 102.

The front and back position of the back shell 40 and back support 32 is changed by loosening the retention bolts 80, horizontally moving the back shell 40 forward or backward relative to the canes 36 or 37 (which causes the depth adjustment bracket 78 to move forward or backward relative to the cane attachment bracket 60), and then tightening the retention bolts 80 when the back shell 40 is in the desired position.

The connection of the angle adjust bracket 72 to the depth adjustment bracket 78 allows vertical adjustment of the back shell 40 relative to the canes 36 or 37 between the highest fine adjustment position (FIG. 7A) and the lowest fine adjustment position (FIG. 7B). Aligned vertical slots 108 are formed in each angle adjust bracket 72 to align with holes 110 formed in each depth adjustment bracket 78. Each angle adjust bracket 72 is attached to a depth adjustment bracket 78 by positioning the angle adjust bracket 72 inwardly of the depth adjustment bracket 78, aligning the vertical slots 108 of the angle adjust bracket 72 with the holes 110 of the depth adjustment bracket 78, inserting a flange nut 112 into each vertical slot 108 from the inward facing surface of the angle adjust bracket 72 with the flange portion of the flange nut 112 contacting the inward facing surface of the angle adjust bracket 72, inserting the bolts 82 through the holes 110 from the outward facing surface of the depth adjustment bracket 78, and tightening the retention bolts 82 into the flange nuts 112 to secure the angle adjust bracket 72 to the depth adjustment bracket 78.

The vertical position of the back shell 40 is changed by loosening the retention bolts 82, vertically moving the back shell 40 up or down relative to the cane attachment bracket 60 to the extent permitted by the vertical length of the slots 108, and then tightening the retention bolts 82 when the back shell 40 is in a desired position. Of course, the vertical height of the back shell 40 can also be adjusted by loosening the retention bolts 64 which control the retention from the pinch clamp arms 62 to the clamp body portion 90 as previously discussed. The vertical adjustment provided by moving the angle adjust bracket 72 relative to the depth adjustment bracket 78 along the length of the vertical slots 108 is used principally to finely adjust the height of the back shell 40, while movement of the cane adjustment brackets 60 relative to the canes 36 or 37 is for more coarse adjustment of the height of the back shell 40. This fine vertical adjustment capability of the adjustment assembly 70 is significant in the circumstance where accessories mounted to the canes 36 restrict the mounting positions of the cane attachment brackets 60.

The angle adjust brackets 72 also allow for the forward and backward pivoting orientation of the back shell 40 between a maximum rearwardly reclined orientation (FIG. 5A) and a maximum forward inclined orientation (FIG. 5C). Each angle adjust bracket 72 has a pivot hole 114 formed in a lower portion and an arcuate shaped slot 116 formed in an upper portion. The radial center point of the arcuate slot 116 is the pivot hole 114. Lower and upper threaded holes 118 and 120 are formed into the outward facing surface of the latch assembly 66. The distance between the centers of the holes 118 and 120 is the same as the distance between the centers of the arcuate slot 116 and the pivot hole 114.

The latch assembly 66 is connected to the angle adjust bracket 72 by the pivot bolt 74 and the angle retention bolt 76. The pivot bolt 74 is passed through the pivot hole 114 from an outward facing surface of the angle adjust bracket 72, through a spacer washer 122, and then threaded into the lower threaded hole 118. The angle retention bolt 76 is passed through the arcuate slot 116, passed through a spacer washer 124, and then threaded into the upper threaded bolt hole 120. The spacer washers 122 and 124 separate the angle adjust bracket 72 and the latch assembly 66 to prevent interference between the flange portions of the flange nuts 112 and the latch assembly 66 when the latch assembly 66 pivots relative to the angle adjust bracket 72, as well as to create enough space for movement of an actuation lever 152 of the latch assembly 66 when operating the latch assembly 66.

The pivoted angle of the back shell 40 is adjusted by loosening the angle retention bolt 76 and the pivot bolt 74, pivoting the back shell 40 to a desired pivoted orientation relative to the canes 36 or 37, and then tightening the angle retention bolt 76 and pivot bolt 74. The pivot bolt 74 is formed and threaded into the lower hole 118 in a manner which secures a rigid pivot point for the latch assembly 66 relative to the angle adjust bracket 72 but which does not interfere with the pivoting movement of the latch assembly 66 relative to the angle adjust bracket 72.

The details of the latch assembly 66 are described below with reference to FIGS. 9A-9C. The latch assembly 66 is formed by a generally C-shaped receiver body 130. The open portion of the receiver body 130 faces forward toward the back shell 40. Inward and outward facing side plates 132 and 134 are respectively attached to the inward and outward facing sides of the receiver body 130. The inward and outward facing side plates 132 and 134 each have an upper forward facing generally rectangular opening 136 and a lower backward and downward facing converging opening 138. The upper and lower openings 136 and 138 are formed in part by edges of the side plates 132 and 134. An edge 140 of the side plates 132 and 134 defines the converging aspect of the lower opening 138.

Extending between the two side plates 132 and 134 and positioned above and below the openings 138 and 136 are a receiver post 142 and a latch post 144. The posts 142 and 144 each extend through openings formed in the inward and outward facing side plates 132 and 134. A latch receiver 146 is pivotally mounted to the receiver post 142. The latch receiver 146 has a U-shaped portion 148 defined by legs 143 and 145. The latch receiver 146 rotates between a forward open and unlocked position shown in FIG. 9B in which the U-shaped portion 148 extends outward within the upper opening 136 of the receiver body 130, and a closed locked position shown in FIG. 9A where the U-shaped portion 148 extends generally vertically upward within the upper opening 136 of the receiver body 130. When the U-shaped portion 148 extends upwardly in the closed locked position, leg portion 145 of the U-shaped portion 148 blocks the upper opening 136 of the receiver body 130, as shown in FIG. 9A.

Forward rotational movement of the latch receiver 146 is limited by a forward stop pin 147 which extends between the inner and outer facing side plates 132 and 134. Rearward rotational movement of the latch receiver 146 is limited by an adjustable set screw 149 threaded through a hole in a rear portion of the C-shaped receiver body 150. By adjusting the position of the set screw 149 relative to the latch receiver 146, a predetermined range of pivoting movement of an upper latch pin 180 (FIG. 9A) relative to a lower latch pin 182 (FIG. 9A) is permitted. This predetermined range of pivoting movement provides a slight range of dynamic pivoting retention of the back support 32 which permits the user to experience a slight amount of forward and backward free pivoting movement of the back support 32. Some users prefer a slight amount of this free dynamic forward and backward pivoting movement of the back support 32. If the user does not prefer to experience this slight range of dynamic movement, the set screw 149 is tightened to prevent the latch receiver from pivoting in a rearward direction. In this manner, the set screw 149 acts as an adjustable stop to limit and adjust the predetermined range of free pivoting movement of the back support 32 by limiting the range of pivoting movement of the latch receiver 146 while it is in a closed locked position shown in FIG. 9A.

Figure 9A:
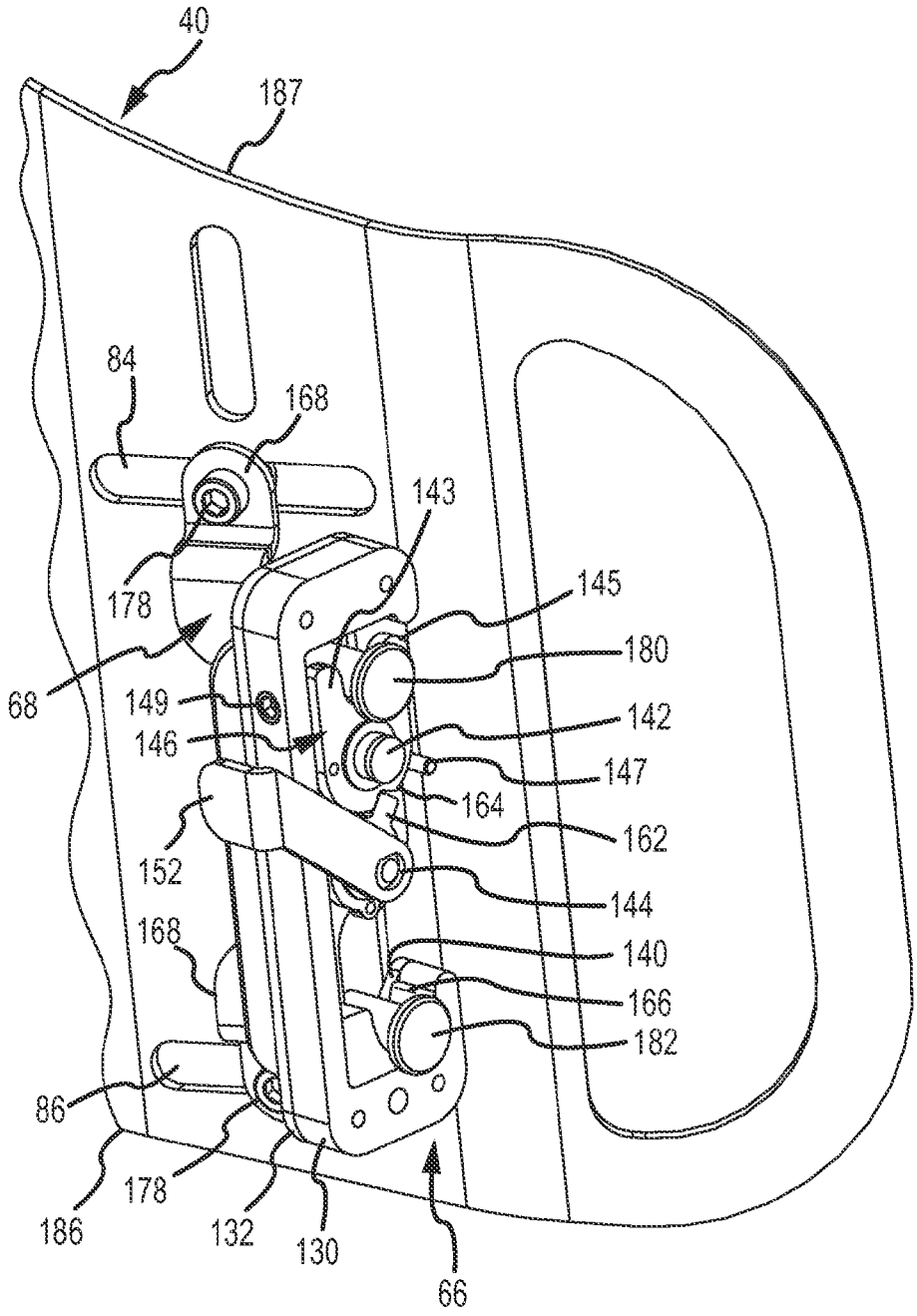
FIGS. 9A, 9B and 9C are perspective views of an attachment assembly of the back support orientation mechanism, with portions broken away to reveal internal components. Specifically.
Figure 9B:
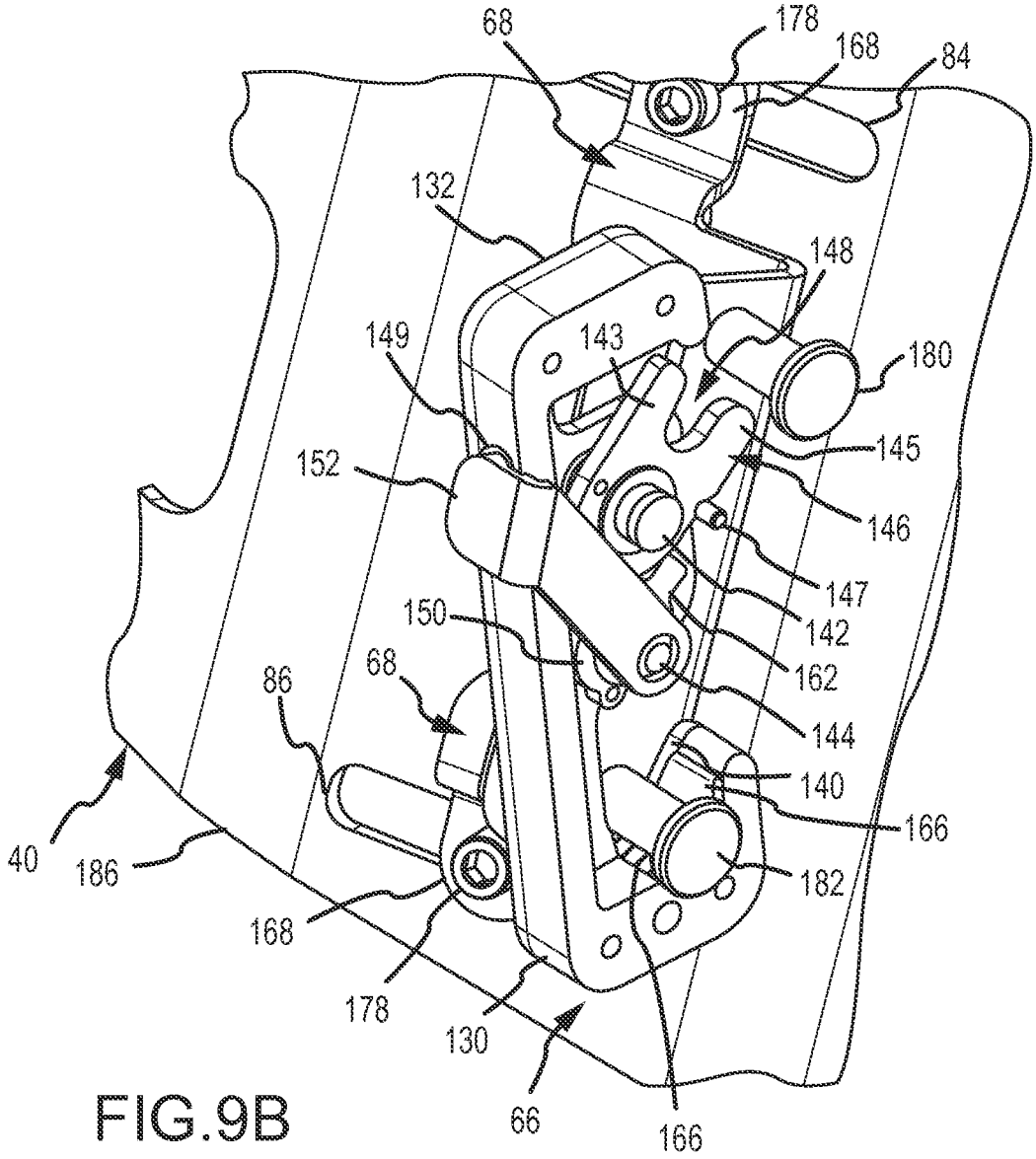
Figure 9C:
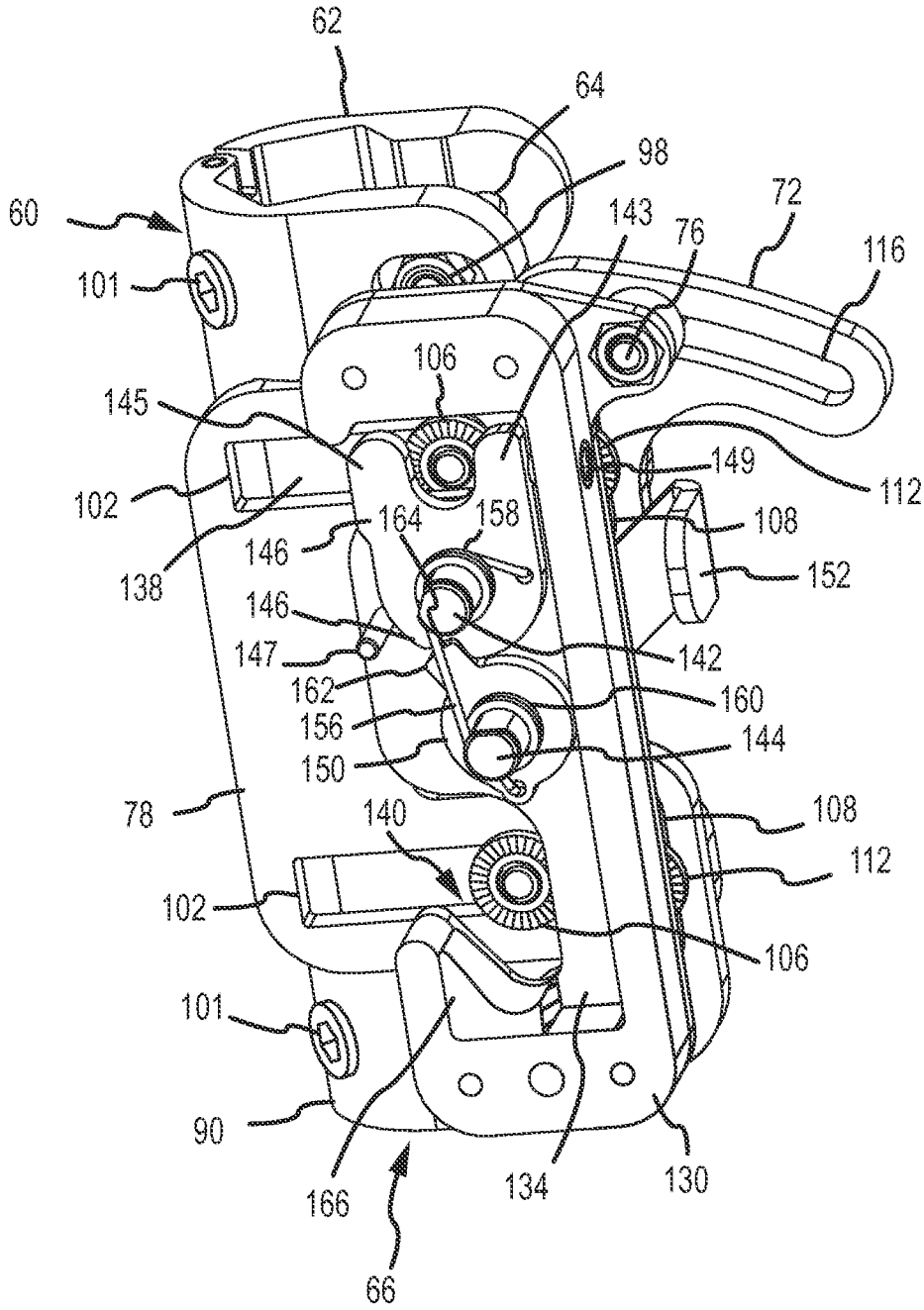

A latch release cam 150 is attached to the latch post 144 and rotates between a locked position shown in FIG. 9A and an unlocked position shown in FIG. 9B when the latch post 144 is rotated. An actuation lever 152 is positioned on the outward facing side of the outward side plate 134 and is attached to the latch post 144 to rotate the latch post and the latch release cam 150 when the actuation lever 152 is pivoted. A flat chord surface 154 of the otherwise cylindrical latch post 144 is received within correspondingly shaped openings in the latch release cam 150 and the end of the actuation lever 152. The flat chord surface 154 causes the latch release cam 150 and the actuation lever 152 to rotate in unison with the latch post 144, when rotated by pivoting movement of the actuation lever 152.

A dual coil bias spring 156 is formed by an upper coil 158 which winds around the receiver post 142 and a lower coil 160 which winds around the latch post 144. Right-angled ends of the bias spring 156 are inserted into holes formed into the latch receiver 146 and in the latch release cam 150. Winding the coils 158 and 160 around the posts 142 and 144 develops bias force which is transferred to the latch receiver 146 and the latch release cam 150. The latch receiver 146 is biased into the forward-pivoted open position (FIG. 9B), and the latch release cam 150 is biased into the rearward-pivoted closed position (FIG. 9A). A tooth 162 projects from the latch release cam 150 and into a V-shaped recess 164 formed in the latch receiver 146 to hold the latch receiver 146 in the closed locked position (FIG. 9A). The tooth 162 in the recess 164 prevents the latch receiver 146 from pivoting from the closed locked position (FIG. 9A) to the open unlocked position (FIG. 9B).

A deformable elastomer piece 166 is located within a bottom portion of the C-shaped receiver body 130 in a position to be exposed in the lower opening 138. The elastomer piece 166 has a concave arcuate recess, similar to the convergence of the lower opening 138, when viewed from the inward and outward sides of the latch assembly 66. The elastomer piece 166 is positioned slightly above the converging edges 140 of the lower opening 138. The purpose of the elastomer piece 166 is to induce a slight resilient force on a lower latch pin 182 (FIG. 9B) which is received within the lower opening 138. The resilient force results from compressing the elastomer piece 166, and that resilient force has the effect of eliminating mechanical clearance which could cause rattling of the latch pins 180 and 182 (FIG. 9A) in the latch assembly 66 when the user operates the wheelchair.

Each back shell attachment bracket 68, which connects the back shell 40 to both latch assemblies 66, has upper and lower base mounts 168 which mate against flat mounting areas 170 on a back surface of the back shell 40, as shown in FIGS. 4, 9A, 9B and 10. Bolt holes 172 are formed in each of the upper and lower base mounts 168 to align with vertically spaced apart horizontal slots 84 and 86 formed in the mounting areas 170 of the back shell 40. The back shell attachment brackets 68 are connected to the back shell 40 by positioning the upper and lower base mounts 168 against the mounting areas 170, aligning the bolt holes 172 with the horizontal slots 84 and 86, inserting flange nuts 176 into the horizontal slots 84 and 86 from the forward side of the back shell 40 with the flange portions of the flange nuts 176 contacting the forward side of the back shell 40 and the nut portion of the flange nuts 176 located in the slots 84 and 86, inserting retention bolts 178 through the bolt holes 172 and tightening the retention bolts 178 into the flange nuts 176. The horizontal slots 84 and 86 allow the position of each back shell attachment bracket 168 to be adjusted relative to the back shell 40.

The distance between the back shell attachment brackets 68 is adjustable to accommodate different widths between the cane 36 of different types of wheelchair frames 38. Typically, the back shell attachment brackets 68 are spaced equidistant from the lateral center of the back shell 40, but may also be positioned off-center depending on the needs of the user 44. The back shell attachment brackets 68 are also typically attached to the back shell 40 with both lateral top and bottom edges (186 and 187, FIG. 10) of the back shell 40 at the approximately same height relative to the rest of the wheelchair 34. However, the slots 84 and 86 allow a lateral angular orientation of the back shell 40 with one side raised higher than the other side, by adjusting the positions of the back shell attachment brackets 68 relative to the slots 84 and 86 in conjunction with raising one of the back support orientation mechanisms 30 higher than the other on the canes 36. In a similar manner, the slots 84 and 86 also provide enough adjustment to allow one side of the back shell 40 to be moved forward or backward to a greater extent than the other side is moved forward and backward, and to permit pivoting of the back shell 40 at one of the back support orientation mechanisms 30 to a different orientation than the orientation of back shell at the other side of the back shell. In general, the length of the slots 84 and 86 accommodates all of these types of movement by loosening the retention bolts 178 and then tightening them once the desired orientation has been obtained. Additionally, the slots 84 and 86 allow the back shell 40 to be mounted to wheelchairs having different widths.

Extending outwardly from each back shell attachment bracket 68 is a pair of vertically spaced apart, upper and lower latch pins 180 and 182. The latch pins 180 and 182 connect the back shell attachment brackets 68 to the latch assemblies 66. The latch pins 180 and 182 are received within the upper and lower openings 136 and 138, while the latch assemblies 66 are in the open unlocked position (FIG. 9B) by pivoting the actuation lever 152 forward. The forward-pivoted actuation lever 152 causes the tooth 162 of the latch release cam 150 to disengage from the V-shaped recess 164 of the latch receiver 146, and the latch receiver 146 rotates forward to the open unlocked position (FIG. 9B) due to force from the upper coil 158 of the bias spring 156. With the latch receiver 146 rotated forward to the open unlocked position (FIG. 9B), the V-shaped recess 164 rotates backward. The forward pivoting pressure on the actuation lever 152 is then removed, at which point force from the lower coil 160 of the bias spring 156 causes the latch release cam 150 to rotate backwards until the tooth 162 contacts the arcuate portion 184 of the latch release cam 150, as shown in FIG. 9B.

The back shell attachment brackets 68 and the back shell 40 are connected to the latch assemblies 66 by tilting the back shell attachment brackets 68 and back shell 40 forward to insert the lower latch pins 182 into the lower openings 138. The insertion of the lower latch pins 182 into the lower openings 138 continues until the lower latch pins 182 contact the elastomer pieces 166 at the bottom of the lower converging opening 138, as shown in FIG. 9B. The back shell attachment brackets 68 and back shell 40 are then rotated around the lower latch pins 182 until the upper latch pins 180 enter the upper opening 136 and the U-shaped portions 148 of the latch receivers 146. Continued pivoting movement in this manner pushes the upper latch pins 180 into the U-shaped portions 148 sufficiently to cause the latch receivers 146 to rotate to the closed locked position (FIG. 9A). As the latch receivers 146 rotate to the closed locked position, the force from the lower coil 160 of the bias spring 156 moves the teeth 162 of the latch release cam 150 into the V-shaped recesses 164 of the latch receivers 146.

With the latch release cam 150 rotated backward, the teeth 162 within the V-shaped recesses 164 retain the latch receivers 146 in the closed locked positions (FIG. 9A). The upper latch pin 180 is constrained within the upper opening 136 by the leg 145 of the U-shaped portion 148 of the latch receiver 146, and the lower latch pin 182 is constrained within the lower opening 138 by the convergence of the lower opening 138. The back shell 40 and attachment brackets 68 are released from the latch assemblies 66 by pivoting the actuation levers 152 forward and removing the back shell 40 and latch pins 180 and 182 from the latch assemblies 66 in a manner reversed from the connection described. Connecting the back shell attachment brackets 68 to the front portion of the latch assemblies 66 eliminates the possibility that the back shell 40 and the user will fall backwards in the event that the latch assemblies 66 are inadvertently released.

The physical spacing between the upper opening 136 and the arcuate recess of the elastomer piece 166 is slightly less than the spacing between the upper and lower latch pins 180 and 182. The reduced spacing causes the lower latch pin 182 to deform the elastomer piece 166 slightly when the upper latch pin 180 retained by the latch assembly 66. The back shell attachment brackets 68 are thus restrained from vertical movement relative to the latch assemblies 66 to prevent mechanical rattling of the latch pins 180 and 182 within the openings 136 and 138.

Figure 3A:
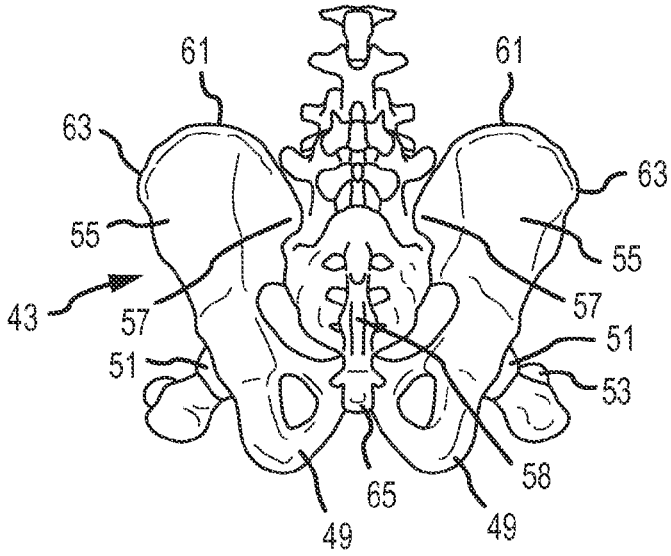
FIGS. 3A and 3B are rear elevation and side elevation views of a typical pelvic skeletal structure of a human who may use the present invention, respectively.
Figure 3B:
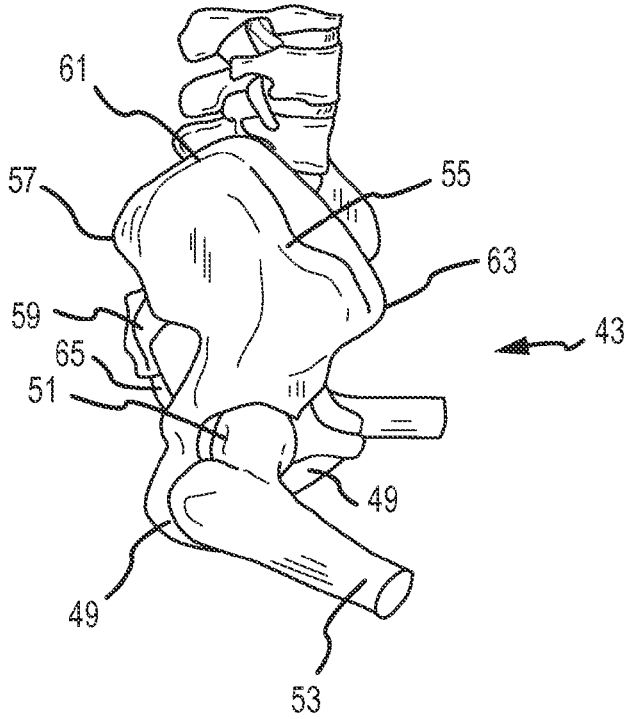
Figure 4:
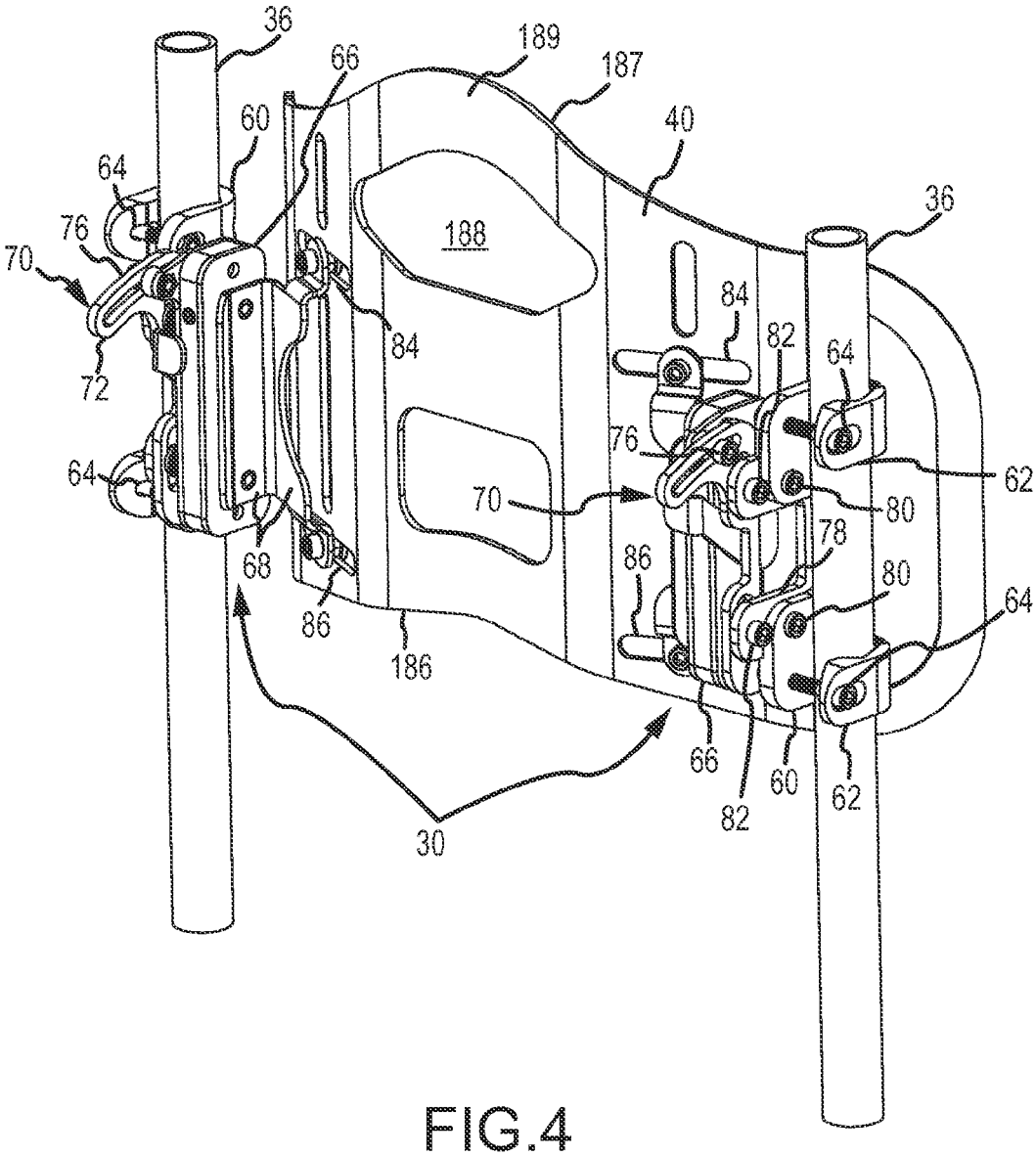
FIG. 4 is an enlarged perspective view of a portion of FIG. 2, showing the back support orientation mechanism attached to a back shell.
Figure 10:
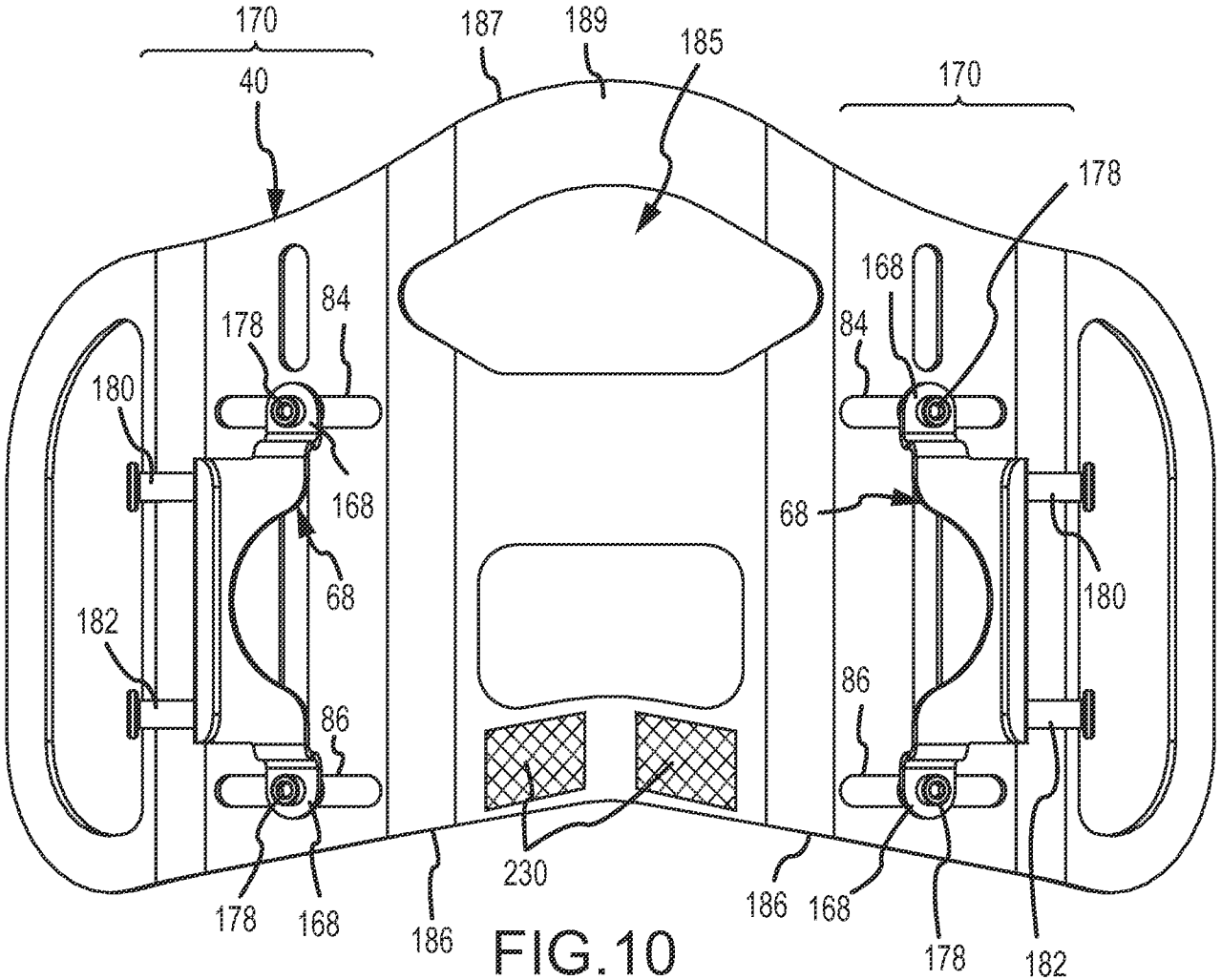
FIG. 10 is a rear elevation view of the back shell shown in FIGS. 4 and 9A-9C.

A lower edge 186 of the back shell 40 has a vertical shape that delivers support through the back support 32 to the posterior superior iliac spines 57 and the iliac crests 61 (FIGS. 3A and 3B). As shown in FIG. 10, the lower edge 186 of the back shell 40 tapers transversely inward and upward, with an uppermost position of the lower edge centered above and behind a sacrum 59 of the pelvic skeletal structure 43 (FIGS. 3A and 3B) when the pelvic area 42 is supported from the seat support 46 and the back support 32 transfers support to the posterior superior iliac spines 57 and the iliac crests 61. The lower edge 186 resembles an obtusely angled inverted V-shape. An upper edge 187 of the back shell 40 also tapers transversely inward and upward. An opening 188 is formed in the back shell 40 adjacent to the upper edge 187 at a position which is generally laterally centered with respect to the back shell 40. The material of the back shell 40 between the opening 188 and the upper edge 187 defines a handle 189. The handle 189 is grasped to lift the back shell 40 from the wheelchair 34. The handle 189 is also used to retain the back support cushion 47 to the back shell 40.

One of the advantages of the back support mechanism 30 as previously described is that the back support 32 will not fall posteriorly, if for some reason the latch assemblies 66 should be accidentally released and moved to the open unlocked position. The back support 32 will remain in front of the canes 36 or 37, thereby reducing the risk of potential injury to the wheelchair user from falling backwardly through the canes. The nature of the connection of the back support orienting mechanisms 30 on the canes 36 or 37 causes the canes themselves to diminish the risk of injury to the wheelchair user from falling rearwardly against the canes.

Figure 11A:
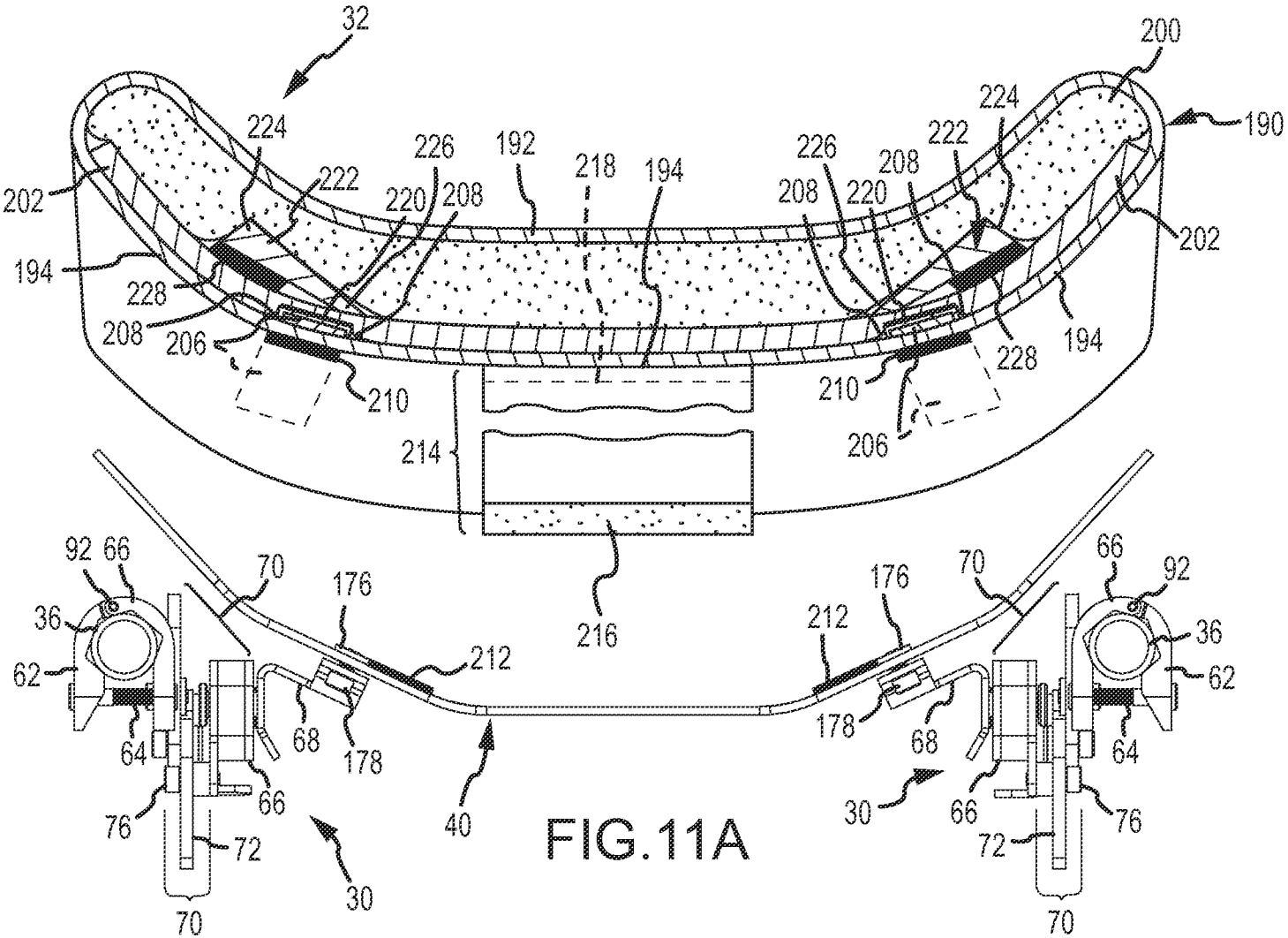
FIG. 11A is a top view of the back support orientation mechanism, the back shell, cane portions of the wheelchair, and the back support cushion which constitutes another aspect of the invention, with the back support cushion shown in cross-section and exploded forward from the back shell.
Figure 11B:
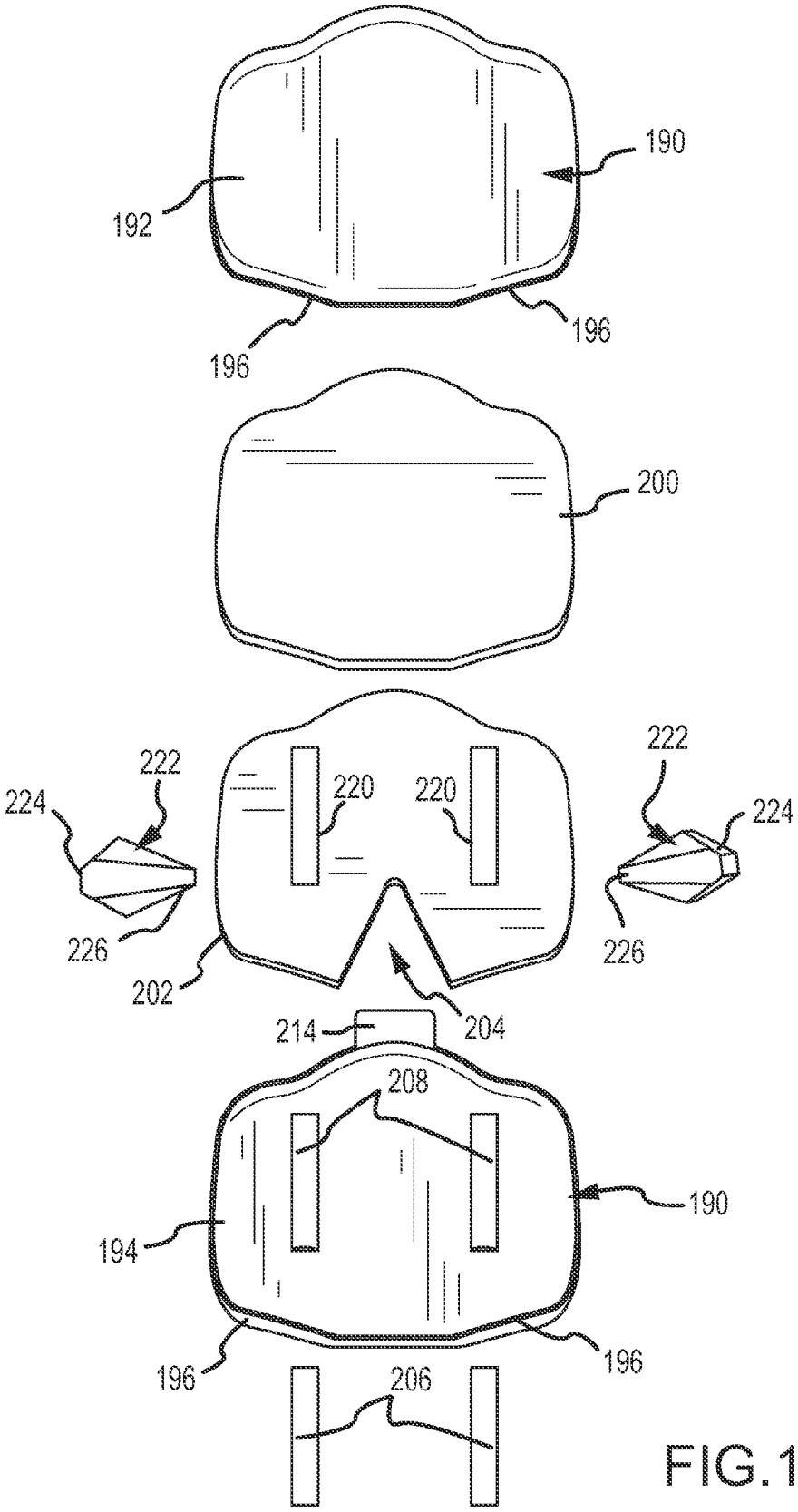
FIG. 11B is an exploded perspective view of the components and assembly of the back support cushion shown in FIG. 11A.

A more complete understanding of the functionality and the mechanical and assembly details of the back support cushion 47 are shown and described in conjunction with FIGS. 11A and 11B. The back support cushion 47 is confined by an outer envelope cover 190. The envelope cover 190 is formed by two pieces of cover material, a front cover piece 192 and a rear cover piece 194. The front and rear cover pieces 192 and 194 are connected together along their peripheral edges, preferably by sewing, to create the outer envelope cover 190. The cover pieces 192 and 194 are joined by a zipper 196 or other conventional faster along a bottom edge 198 of the envelope cover 190 and the back support 32. Opening the zipper 196 allows access within the envelope cover 190 for assembling the internal components of the back support 32. After assembly, the zipper 196 is closed.

The envelope cover 190 encloses a padding layer 200 which generally takes the shape of the outer periphery of the back support 32. The padding layer 200 is preferably a conventional open cell foam material which provides resilient padding for the user against which to rest his or her upper torso 48. The padding layer 200 is located in front of a flexible contour adjustment platform 202. The contour platform 202 is preferably a uniform thickness piece of thermo-moldable closed cell foam which generally has the shape of the outer periphery of the back support 32. A V-shaped notch 204 is formed in the foam layer 200 at a location centered along the bottom edge 186 of the back support cushion. The purpose of the V-shaped notch 204 is to provide a relief area to prevent undue pressure on the sacrum 59 of the pelvic skeletal structure 43 of the user (FIGS. 3A and 3B). In general, an upper point of the V-shaped notch 204 is located coincidentally with the lower edge 186 of the back shell 40 (FIG. 10). A commercially available type of material suitable to form the platform 202 is "Plastazote," a cross-linked polyethylene block foam which is sometimes used to create orthopedic prosthetics. Such material is available from numerous commercial sources.

Elongated and rectangularly shaped brace members or stays 206 are also confined within the envelope cover 190. The stays 206 are located behind the contour platform 202. The stays are adjustable and are intended to transfer support and confinement through the contour platform 202 and the foam layer 200 to the gluteal or buttocks tissue of the wheelchair user. As described below, the lower edge 186 of the back shell 40 terminates above the majority of the gluteal or buttocks tissue 236 (FIGS. 17 and 18) of the user. Consequently, the back shell 40 does not provide substantial support for the gluteal or buttocks tissue. However, as described below, the stays 206 extend below the lower edge 186 the back shell 40 to create the majority of the support and confinement of the gluteal or buttocks tissue 236 in conjunction with the contour platform 202.

The stays 206 are confined to the rear cover piece 194 of the envelope cover 90 by insertion into pockets 208. Each pocket 208 is formed by sewing or attaching a strip of material to the inside surface of the rear cover piece 194. The width of each pocket 208 is slightly greater than the width of the stay 206, causing the stay 206 to remain firmly in position without substantial side-to-side lateral or pivoting movement when each stay 206 is inserted in each pocket 208.

As shown in FIG. 11A, the location of each pocket 208 on the inside of the rear cover piece 194 is adjacent to a strip 210 of conventional hook and loop fastener material which is attached to the outside surface of the rear cover piece 194. The hook and loop strip 210 is attached to the outside surface of the lower cover piece 194 by sewing, or with an adhesive.

The hook and loop strip 210 on the rear cover piece 194 mates with a complementary strip 212 of hook and loop material which has been attached to the back shell 40, preferably with an adhesive. Mating the hook and loop strips 210 and 212 holds the back support cushion 47 in place on the back shell 40.

The back support cushion 47 is also held in place on the back shell 40 by a flap 214 of the same type of material as the rear cover piece 194 which extends from an upper edge of the lower cover piece 194. The flap 214 has a strip 216 of conventional hook and loop material attached to it, and a complementary strip 218 of conventional hook and loop material is attached to the outer surface of the rear cover piece 194 adjacent to the location from which the flap 214 extends. As shown in FIG. 1B, the flap 214 is folded over the handle 189 (FIG. 10) in the back shell 40 near the upper edge 187 of the back shell 40, and the hook and loop strip 216 on the flap 214 is connected with the hook and loop strip 218 on the rear cover piece 194 to hold the back support cushion 47 against the rear shell 40.

Sufficient retention force for holding the back support cushion 47 on the back shell 40 is available from mating the hook and loop strips 210 and 212 on the rear cover piece 194 and on the back shell 40, and from wrapping the flap 214 around the handle 189 and connecting the hook and loop strips 216 and 218. Retained in this manner, the back support cushion 47 is retained in a consistent, effective position on the back shell as part of the back support 32.

Elongated vertical strips 220 of conventional hook and loop material are attached on laterally opposite sides of the front surface of the contour platform 202. The strips 220 are positioned to mate with conventional hook and loop material (not shown) attached on the back side of pelvic support wedges 222. The pelvic support wedges 222 taper in both the transverse and height dimensions from a broader and thicker end 224 to a narrower and thinner end 226. As discussed below, the pelvic support wedges 222 are included within the back support 32 to provide support for the posterior-lateral surfaces of the superior aspect of the pelvic skeletal structure 43 at iliac crests 61 of the illums 55 (FIGS. 3A and 3B). Different thicknesses of pelvic support wedges 222 are used to obtain different degrees of support, or multiple pelvic support wedges 222 are stacked on one another by adhering conventional hook and loop material to the adjoining pelvic wedges to obtain the necessary amount of support.

Two additional strips 228 of conventional hook and loop material are attached to the rear surface of the contour platform 204. These additional strips 228 are used to hold the contour platform 202 in position when fitting the components of the back support cushion 47 to the user, as described below. These additional fitting strips 228 are located in a position which generally coincides with the location of the pockets 208 and the stays 206 within the pockets 208.

The back support 32 is assembled, after it has been fitted in the manner described below in connection with FIGS. 12-16, by inserting the foam layer 200 into the envelope cover 190 through the opening created by opening the zipper 196. The contour platform 202 with the attached pelvic support wedges 222 is inserted through the zipper opening and positioned behind the padding layer 200. The stays 206 are inserted in the pockets 208. At this point, the internal components of the back support 32 are complete, and the zipper 196 is closed to confine those internal components of the back support cushion 47 within the cover envelope 190.

A more complete understanding of the fitting and use of the back support 32 is obtained by reference to the following description and FIGS. 12-18.

Figure 12:
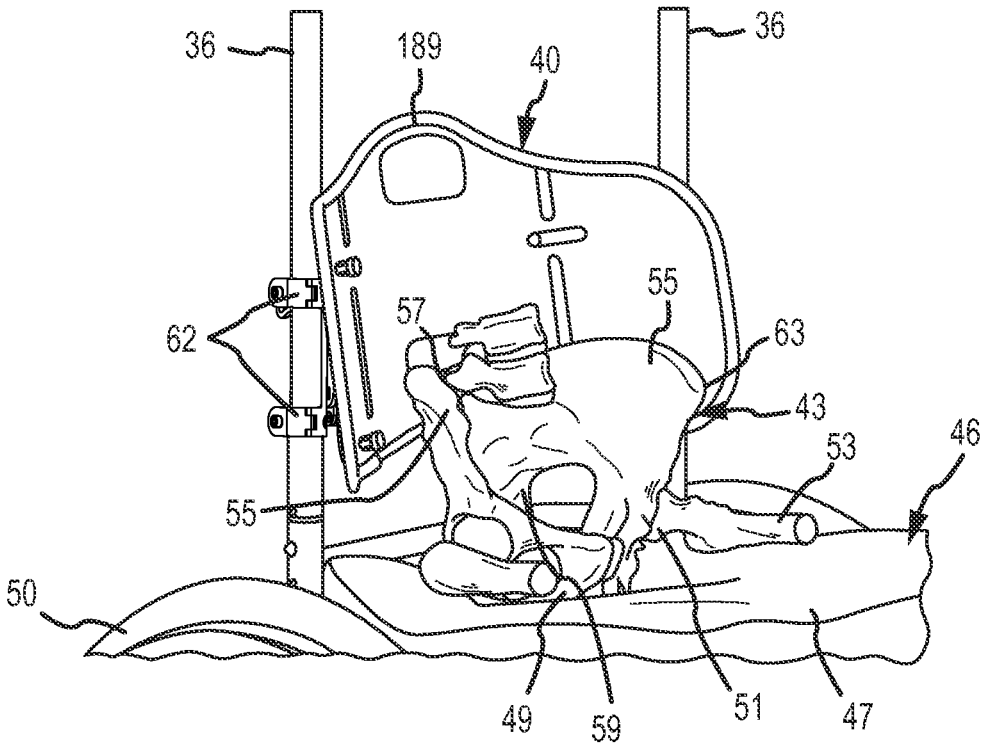
FIGS. 12-16 are perspective views showing use of the back support orientation mechanism in accordance with one aspect of the invention and also showing a method of forming and fitting the back support cushion in accordance with another aspect of the invention. Specifically.

As shown in FIG. 12, the wheelchair 34 is positioned stationarily, and the seat support 46 is located by the wheelchair frame 38. The seat support 46 has been fitted previously to the user to provide the desired pelvic support. The contour and support characteristics of the seat support 46 may function according to a variety of different theories, including the preferred support characteristics described in U.S. Pat. No. 7,216,388, but the benefits and improvements of the present invention are available regardless of the type of seat support or support theory that may be employed.

Figure 13:
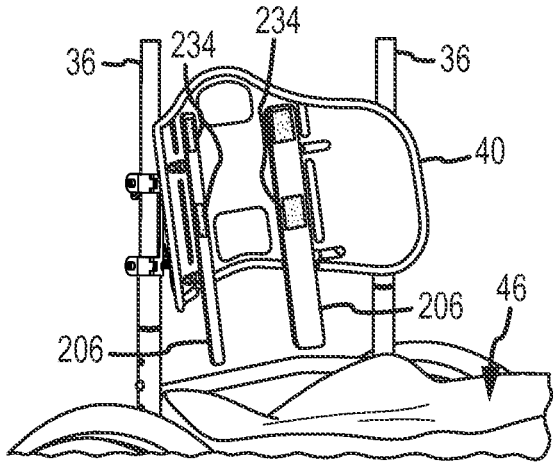
Figure 14:
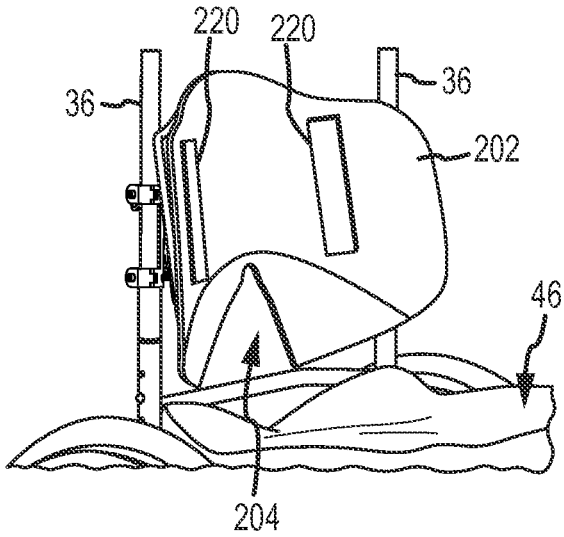

The back shell 40 has previously been attached to the canes 36 or 37 of the wheelchair frame 38 using the back support orientation mechanisms 30. The cane attachment bracket 60 is loosely connected to the canes 36 or 37 to allow vertical movement of the back shell 40 relative to the pelvic area 42 and upper torso 48 of the user. The stays 206 are attached to the hook and loop strips 212 on the back shell 40. The hook and loop strips 212 are located on the back shell 40 at the position in which the stays 206 will be retained in the pockets 208, when the back support cushion 47 is attached and retained to the back shell 40. By placing the stays 206 on the hook and loop strips 212 as shown in FIG. 13, the stays 206 will be fitted to the user in the same orientation that they will occupy in the seat support 32.

To facilitate placement of the stays 206 on the hook and loop strips 212, small pieces 234 of hook and loop material are attached to the front and back sides of the stays 206. The hook and loop pieces 234 are used only for the purpose of fitting. When the stays are inserted in the pockets 208, the hook and loop pieces 234 are inserted entirely within the pockets 208. After the stays 206 have been temporarily attached to the forward facing surface back shell 40 as shown in FIG. 13, the contour platform 202 is temporarily attached to the forward facing surface of the stays 206 using the pieces 234 of hook and loop material.

The contour platform 202 is attached to the stays 206 in the same position that the contour platform will occupy in the assembled back support 32. This position is established relative to the stays 206 and the upper edge 187 (FIG. 10) of the back shell 40. The rearward facing hook and loop strip 220 on the contour platform 202 is connected to the forward facing hook and loop pieces 234 on the stays 206 (FIG. 14) to hold the contour platform 202 in the use position. With the contour platform 202 located in this use position, the size, shape and orientation of the V-shaped notch 204 in the contour platform 202 can be evaluated to avoid introducing undesirable pressure on the sacrum 59 of the pelvic skeletal structure 43 (FIGS. 3A and 3B) from the back support cushion 47. To the extent that the notch 204 needs to be adjusted in size or position, material from the contour platform 202 is cut away.

Although the contour platform 202 is shown with a preformed V-shaped notch 204, the contour platform 202 could be supplied without the V-shaped notch 204 to allow an appropriately shaped notch to be cut into the contour platform 202 having size, shape and location to avoid the sacrum 59 of the individual wheelchair user. After the stays 206 and the contour platform 202 have been temporarily attached to the back shell 40, the user is positioned on the seat support 46.

With the user seated on the seat support 46, the back support orientation mechanisms 30 are moved along the upright extending canes 36 or 37 until the pivot point at the pivot bolt 74 is generally horizontally aligned and referenced with the posterior superior iliac spines 57 of the pelvic skeletal structure 43 in the pelvic area 42 (FIGS. 3A and 3B). This alignment will generally position the lower edge 186 of the back shell 40 a very slight distance below an alignment reference between the pivot bolt 74 and the posterior superior iliac spines 57. In general, the lower edge 186 of the back shell 40 will be no more than approximately 1 inch (2.5 cm) below the horizontal alignment between the pivot bolt 74 and the posterior superior iliac spines 57. Positioned in this manner, the back shell 40 will transfer support to the posterior superior iliac spines 57 from the areas adjoining and slightly above the lower edge 186 of the back shell 40. Such areas are generally shown in FIG. 10 by crosshatching 230.

It is important that the lower edge 186 of the back shell 40 does not extend farther below the alignment reference between the pivot bolt 74 and the posterior superior iliac spines 57 than is necessary to provide the adequate support to the posterior superior iliac spines 57 to maintain the pelvic structural area in the desired alignment. In general, for most individuals, that desired pelvic structural alignment is a horizontal reference between the posterior superior iliac spines 57 and anterior superior iliac spines 63 (FIGS. 3A and 3B).

Maintaining the lower edge 186 of the back shell 40 no lower than this position of adequate support will have the effect of not distorting the desired alignment of the pelvic skeletal structure 43 relative to the back support 32 and the seat support 46 when the back support 32 is oriented at a desired angle to balance the weight of the users upper torso over the pelvic area 42. As the angular orientation of the seat support 32 is changed, the relative position of the back support 32 to the posterior superior iliac spines 57 is maintained without significant change. Maintaining the support on the posterior superior iliac spines 57 with the back support 32 while changing the orientation of the back support 32 through a wider range of orientations is an essential part of avoiding many of the comfort and safety problems that users might otherwise face.

Once the desired vertical height of the back shell 40 is achieved, with the lower edge 186 positioned in the described manner below the alignment reference between the pivot bolt 74 and the posterior superior iliac spines 57, the retention bolts 64 are tightened to constrict the hinged clamp arms 62 around the clamp body portions 90 of the cane attachment bracket 60 in each back support orientation mechanism 30 (FIG. 8A). If further fine vertical adjustment is desired, the retention bolts 82 are loosened to allow the angle adjust bracket 72 to move upward or downward in each back support orientation mechanism 30, and then the retention bolts 82 are tightened to achieve the final fine vertical adjustment position (FIG. 8A).

Next, as understood from FIG. 12, the forward and backward position of the back shell 40 is established. The forward and backward position is adjusted by loosening the retention bolts 80 to allow the depth adjustment bracket 78 to move forward or backward and then tightening the retention bolts 80 once the desired forward and backward adjustment position is achieved.

Figure 15:
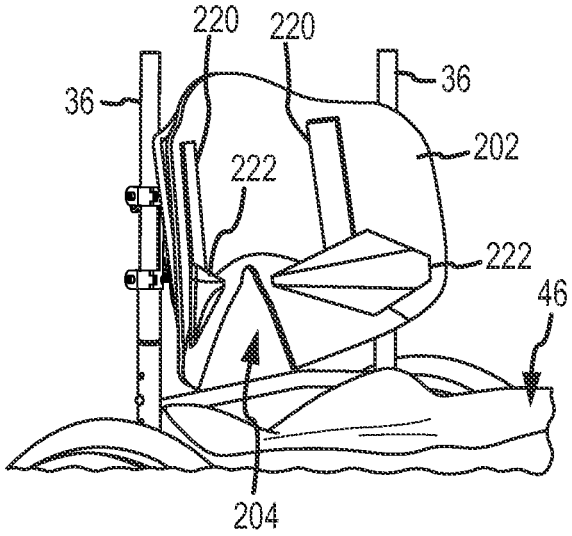

With the contour platform 202 remaining in the same position that it will occupy in the assembled back support 32, as shown in FIG. 15, and with the user seated on the seat support 46 and leaning back against the contour platform 202, the pelvic support wedges 222 are inserted between the contour platform 202 and the user's body at the level of the posterior lateral iliac crests 61 (FIGS. 3A and 3B). The position and degree of wedge shape of each support wedge 222 is selected or adjusted until there is adequate lateral and forward support for the pelvic area 42. Establishing the proper degree of support involves trial-fitting different pelvic support wedges 222 having various different inclinations. The hook and loop strips 220 retain the pelvic support wedges 222 in position during this fitting process to obtain the best fit possible.

The next adjustment is the pivot orientation angle of the back shell 40. The optimal pivot orientation of the back support 32 varies for different users. The proper pivot angle establishes a sense of balance which does not make the user feel as though he or she may fall forward or slide out of the wheelchair. A important aspect of the present invention is that the previously adjusted proper posture of the pelvic skeletal structure 43 is not altered when the angle of the back shell 40 is adjusted.

In establishing the proper degree of pivot orientation, the bottom edge 186 of the back shell 40 pivots only very slightly upward or downward while maintaining contact with the posterior superior iliac spines 57 to provide support for the pelvic skeletal structure 43. The slight degree of upward or downward movement of the bottom edge 186 of the back shell 40 results because of the pivot point of the back shell at the pivot bolt 74 is displaced posterior from the point at which the back support 32 contacts the posterior superior iliac spines 57. Most importantly, however, the areas (230, FIG. 10) which provide support for the posterior superior iliac spines 57 do not move forward or backward out of a supporting engaging relationship with those posterior superior iliac spines 57, throughout the entire angular orientation of the back support 32. Reclining the back support 32 maintains the desired level of support on the posterior superior iliac spines 57, thereby maintaining the desired alignment of the pelvic skeletal structure 43 with changes in the angular orientation of the back support 32 and the upper torso 48 supported by the back support 32.

If a different pivot angle is desired on one side of the wheelchair compared to the pivot angle on the other side of the wheelchair, the rigid back shell 40 offers enough torsional flexibility to accommodate such angular differences by moving the positions of the retention bolts 178 in the slots 84 and 86. Differences in forward and backward position of the shell from one side of the wheelchair to the other side of the wheelchair are also accommodated by the movement of the position of the retention bolts 178 in the slots 84 and 86. Differences in height of the back shell 40 from one side of the wheelchair to the other side of the wheelchair are also accommodated by movement of the retention bolts 178 in the slots 84 and 86.

Of course, the ability to make individual adjustments in the orientation of the back shell on opposite sides of the wheelchair results from the multiple independent adjustments available from each back support orientation mechanism 30. These individual adjustments on opposite lateral sides of the wheelchair will accommodate almost any upper torso shape of a wheelchair user and still assure optimal orientation of the upper torso 48 on the back support 32 and optimal alignment of pelvic skeletal structure 43 (FIGS. 3A and 3B) relative to both the back support 32 and the seat support 46.

Figure 16:
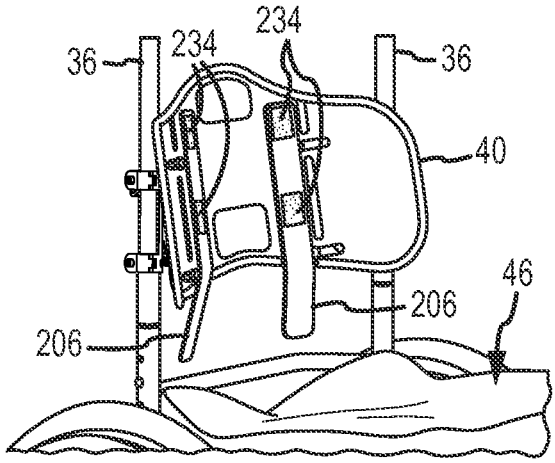
Figure 17:
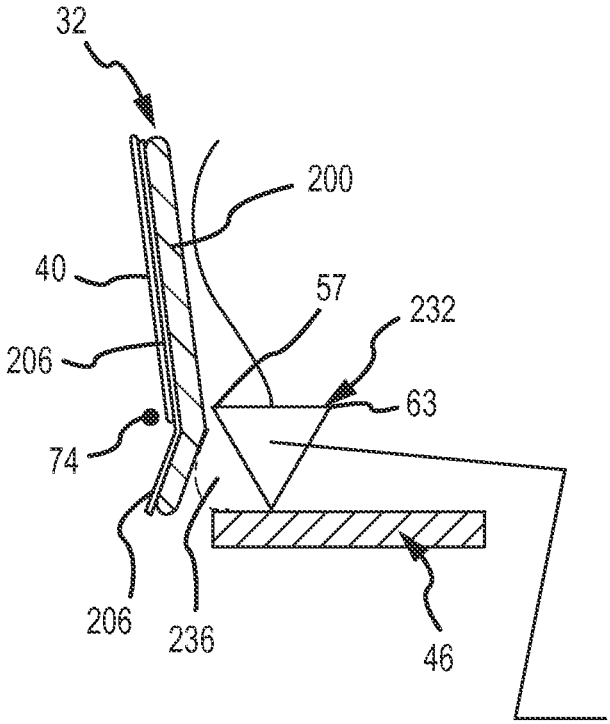
FIG. 17 is a schematic view of a back shell, a support stay and a layer of padding material in the back support cushion relative to the pelvic area and spine of a user, showing an orientation of the back support cushion which obtains optimal support for the pelvic area and for the upper torso with the back shell in a rearward pivoted orientation shown in FIG. 5A, in accordance with the present invention.
Figure 18:
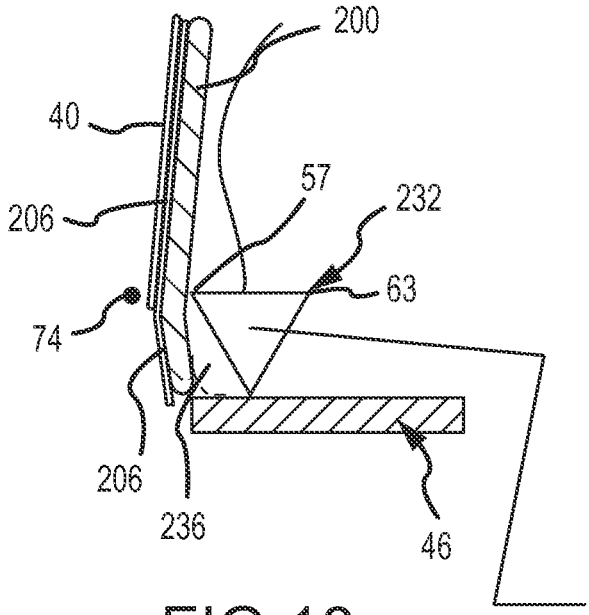
FIG. 18 is a schematic view similar to FIG. 17, showing the support stays and the layer of padding material in the back support cushion in a forward pivot orientation shown in FIG. 5C.

Either after the angular orientation of the back shell 40 has been established, or in conjunction with establishing the angular orientation of the back shell 40, lower portions of the stays 206 below the lower edge 186 of the back shell 40 are bent, at the location of the lower edge 186, as shown in FIG. 16. The contour platform 202 has been removed for clarity in FIG. 16. The lower portions of the stays 206 are each bent into a position which firmly presses against the gluteal and buttocks tissue 236 (FIGS. 17 and 18). The stays 206 are bent to a different degree to accommodate the amount and rearward protrusion of the gluteal and buttocks tissue 236, independent of the amount of angular orientation of the back support 32. When bent, the lower portion of the stays 206 extend at an angular orientation to the upper portion of the stays. The upper portion of the stays extend generally parallel to the back shell 40 along the mounting area 170 (FIG. 10).

As understood from FIGS. 16-18, the gluteal and buttocks tissue 236 typically extends posterior of and below the lower edge 186 of the back shell 40. The lower portion of the stays 206 which extend below the lower edge 186 of the back shell 40 contact and support this gluteal and buttocks tissue, through the contour platform 202. The amount of bend introduced into the stays 206 should be sufficient to provide a level of support and stability to the gluteal and buttocks tissue 236 (FIGS. 17 and 18), without distorting the optimal alignment of the pelvic skeletal structure 43. The inverted V-shaped notch 204 formed in the contour platform 202 allows flaps 232 on opposite sides of the notch 204 (FIGS. 14 and 15) to independently conform to the gluteal and buttocks tissue 236 on opposite lateral sides without creating an undesirable hammock effect. Force from the bent lower portions of the stays 206 is transferred through the flaps 232 of the contour platform 202 to provide the firm support and confining engagement on the tissue 236.

The angular orientation of the inverted V-shape of the lower edge 186 (FIG. 10) has the effect of naturally causing the lower portions of the stays 206 to flare laterally outward when bending posteriorly. The lateral posterior orientation of the bent lower portions of the stays also assists in directing the support and confinement to the gluteal and buttocks tissue 236.

Although FIGS. 16 and 17 show bending the lower portion of the stays 206 rearward relative to the lower edge 186 of the back shell 40, the lower portion of the stays 206 could also be bent forward relative to the lower edge 186, as shown in FIG. 18, depending upon the anatomical characteristics of the gluteal and buttocks tissue 236. Furthermore, if the user has an unusual or severely distorted anatomy, one of the stays 206 could be bent forward while the other could be bent rearward, relative to the lower edge 186 of the back shell 40.

During this fitting process, the stays 206 have been bent to the desired configuration to provide individualized gluteal and buttocks tissue support and confinement. The position and size of the notch 204 in the contour platform 202 has been adjusted or evaluated to avoid excessive pressure from the back support 32 on the sacrum 59. The position of the pelvic support wedges 222 have been established to provide the best support for the pelvic skeletal structure 43 at the level of the posterior iliac crests 61. With these individualized features having been established, the back support 32 can now be assembled.

The contour platform 202 with the optionally attached wedges 222 and the bent stays 206 are removed from the back shell 40. The contour platform 202 with the attached pelvic support wedges 222 is inserted through the open zipper 196 in the envelope cover 190 and positioned behind the padding layer 200. The bent stays 206 are inserted in the pockets 208 in the rear cover piece 194 through the open zipper 196 of the envelope cover 190. The zipper 196 is closed, and the assembled back support 32 is attached to the back shell 40 by wrapping the flap 214 around the handle 189 while contacting the hook and loop strip 210 on the back surface of the rear cover piece 194 to the connecting hook and loop strip 212 on the back shell 40.

In addition to the benefits of individualized support from assembling fitted components into the back support 32 and the adjustments available from the back support orientation mechanism 30, the manner by which desired angular orientation of the back support 32 is achieved does not interfere with the optimal alignment of the pelvic skeletal structure 43 is understood from FIGS. 17 and 18.

As shown in FIG. 17, the lower edge 186 of the back shell 40 terminates slightly below an alignment reference between the pivot point at the pivot bolt 74 and the posterior superior iliac spines 57 of the pelvic skeletal structure 43. The typical desired orientation of the pelvic skeletal structure 43 is shown, with the posterior superior iliac spines 57 and the anterior superior iliac spines 63 oriented approximately horizontally with respect to one another. The horizontal orientation of the posterior and anterior superior iliac spines 57 and 63 will not be the desired pelvic alignment with all users, but is generally considered to be applicable to many users. Pivoting the back shell 40 maintains the support areas 230 (FIG. 10) of the back support 32 in a supportive relationship adjacent to the posterior superior iliac spines 57 even though a slight amount of up or down movement occurs, thereby maintaining the desired alignment of the pelvic skeletal structure 43 by the back support 32. The pelvic skeletal structure 43 remain in their desired and intended orientation relative to the back support 32 and the seat support 46, regardless of angular orientation of the back support 32. The portion of the back support 32 below the lower edge 186 of the back shell 40 is oriented at the angle established by the bent stays 206 to provide adequate support and stabilization to the gluteal and buttocks tissue 236, according to the amount, configuration and position of tissue 236 of the particular user. Even when the back shell 40 is pivoted forward and the amount of gluteal and buttocks tissue 236 is minimal, as shown in FIG. 18, the stays 206 may be bent forward to provide stabilization to the gluteal and buttocks tissue 236.

Figure 19:
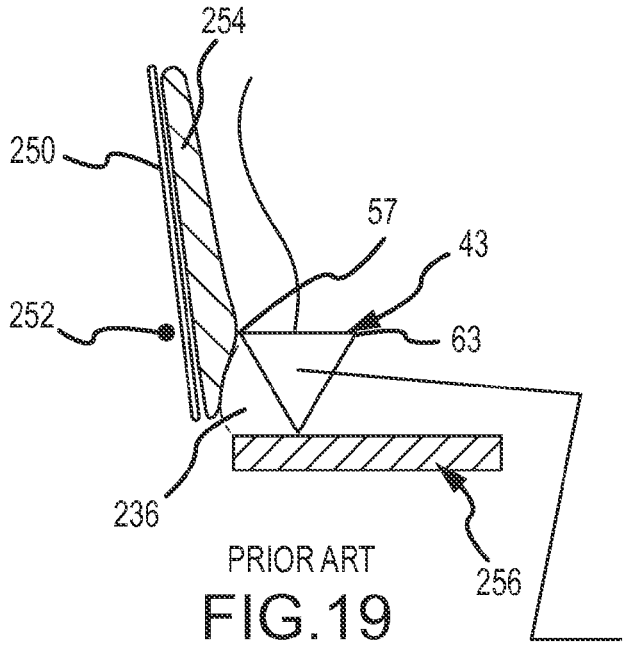
PRIOR ART FIG.19
FIG. 19 is a schematic view of a prior art back support cushion and a retaining back shell relative to the pelvic area and upper torso of a user in one condition of use.
Figure 20:
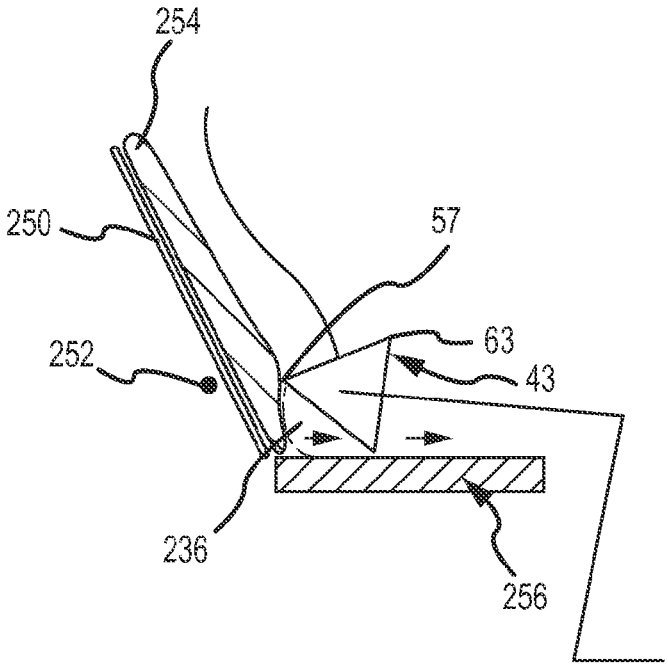
PRIOR ART FIG.20
FIG. 20 is a schematic view similar to FIG. 19, showing an adverse influence from the prior art back shell and back support cushion on the pelvic area of the user when the back support cushion and back shell are pivoted in a rearward orientation.
Figure 21:
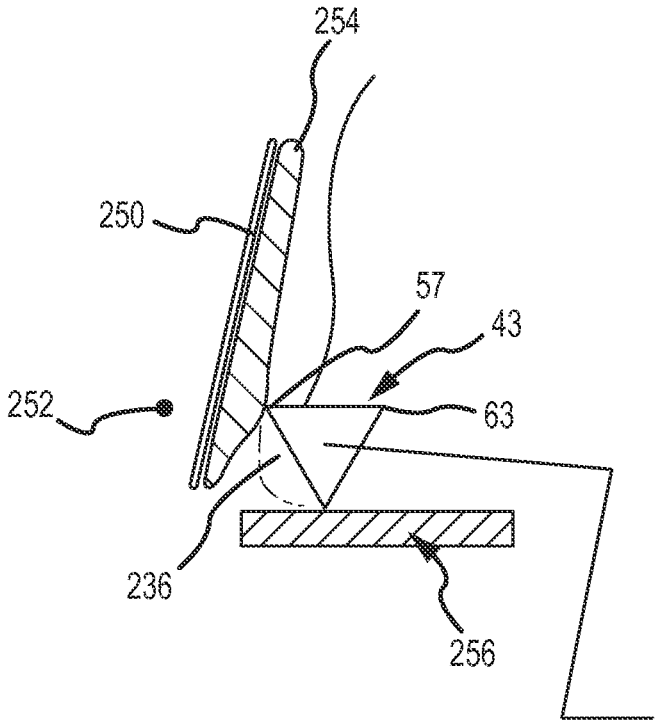
PRIOR ART FIG.21
FIG. 21 is a schematic view similar to FIGS. 19 and 20, showing the lack of support on the gluteal or buttocks area of the user when the back support cushion and back shell are pivoted in a forward orientation.

In contrast to the benefits and improvements shown in FIGS. 17 and 18, the prior art arrangement shown in FIGS. 19-21 pivots a wheelchair back shell 250 about a pivot point 252 which is approximately horizontal relative to the posterior superior iliac spine 57 of the pelvis 43. A lower portion of the prior art back shell 250 extends considerably below the reference between the pivot point 252 and the posterior superior iliac spines 57. When the back shell 250 is pivoted backward, as shown in FIG. 20, the lower part of the back shell 250 and the lower part of a back support cushion 254 below the pivot point 252 move forward, causing an undesirable forward push on the gluteal and buttocks tissue 236 and sacrum 59 below the posterior superior iliac spines 57.

The forward push from the lower portion of the prior art back shell 250 and the back support cushion 254 distorts the relationship of the pelvic skeletal structure 43 with a seat support 256 by pushing the pelvic skeletal structure 43 in a forward or other misaligning direction, creating potentially harmful pressure at the sacrum 59 and coccyx 65 (FIGS. 3A and 3B), and preventing the user from repositioning into the desired alignment. The misaligned pelvic skeletal structure 43 also compromises its desired interaction with the seat support 256, thereby diminishing or eliminating the desired support characteristics derived from the seat support 256. If the distortion is severe enough, the user will experience discomfort, pressure ulcers and skin shear abrasions, among other things. Even tapering the lower portion of the back support cushion 254 rearwardly in a downward direction as shown in FIG. 20, is not adequate to avoid introducing a pushed-forward abnormal orientation of the pelvic skeletal structure 43 if the back shell 250 is pivoted significantly rearwardly.

Furthermore, there is no capability to adjust the interaction of the rearwardly and downwardly tapered lower portion of the back support cushion 254 with the gluteal and buttocks tissue 236 in the prior art arrangement shown in FIGS. 19-21. In contrast, the bent stays 206 in combination with the contour platform constitute the major support structure of the back shell 40 below the pivot point at the pivot bolt 74, as shown in FIGS. 17 and 18, so the best support, confinement and stabilization for the gluteal and buttocks tissue 236 is always established by the degree of bend of the stays 206. In the circumstance represented in FIG. 21, where the prior art back shell 250 is pivoted forwardly, the rearwardly pivoted lower portion of the back shell 250 and the rearwardly tapered lower portion of the back support cushion 254 are separated from the gluteal and buttocks tissue 236, and therefore cannot provide any support, confinement or stabilization whatsoever to that tissue 236. Even the prior art device which hinges the lower portion of the back support cushion lacks the capability to provide adequate support, confinement and stabilization to the gluteal and buttocks tissue 236.

The significance of the benefits and improvements described herein will become more apparent upon gaining a full appreciation of the present invention. Preferred embodiments of the invention and many of its improvements have been described previously with a degree of particularity. This detailed description is of a presently preferred example of implementing the invention. The scope of the invention is defined by the following claims.

We claim:

1. Apparatus for supporting a back support from a frame of a seating device with the back support adaptively contacting an upper torso of a user when a pelvic skeletal structure of the user is supported from a seat support located on the frame of the seating device with gluteal and buttocks tissue of the user located above a rear portion of the seat support, comprising:

a substantially rigid back shell adapted to orient and retain the back support to contact and support the upper torso and posterior superior iliac spines of the pelvic skeletal structure of the user, the back shell having a lower edge; and a back support orientation mechanism connected between the back shell and the frame of the seating device to adaptively position and orient the back support relative to the upper torso and the posterior superior iliac spines of the user while the pelvic skeletal structure is supported from the seat support, and wherein:

the back support orientation mechanism includes a pivot mechanism which is operative to pivot the back shell about a pivot point;

the back support orientation mechanism is operative to adaptively position the lower edge of the back shell below a reference extending between the pivot point and posterior superior iliac spines while the pelvic skeletal structure is supported from the seat support and to adaptively position the lower edge of the back shell above a substantial majority of the gluteal and buttocks tissue;

the back support includes a back support cushion;

the back support cushion includes an upper portion and a lower portion, the upper portion is retained by the back shell to adaptively contact the upper torso and to adaptively transfer support to the posterior superior iliac spines, the lower portion of the back support cushion extends from the upper portion of the back support cushion to a position below the lower edge of the back shell to adaptively contact the gluteal and buttocks tissue of the user;

the back support cushion includes at least one stay member which extends within the back support cushion from the upper portion to the lower portion, the stay member adjustably orienting the lower portion at a predetermined angular orientation relative to the upper portion independently of a pivot orientation of the back shell and the upper portion retained by the back shell, the stay member resisting changes in and maintaining the predetermined angular orientation of the lower portion relative to the upper portion of the back support cushion and the back shell.

2. Apparatus as defined in claim 1, wherein:

the back support orientation mechanism positions the lower edge of the back shell at a location no lower than necessary to adaptively transfer support through the back support to the posterior superior iliac spines.

3. Apparatus as defined in claim 1, wherein:

the lower edge of the back shell tapers transversely inward and upward, with an uppermost position of the lower edge centered adaptively approximately at a sacrum of the pelvic skeletal structure when the pelvic skeletal structure is supported from the seat support and the back support contacts the upper torso to transfer support to the posterior superior iliac spines of the pelvic skeletal structure.

4. Apparatus as defined in claim 1, wherein:

the stay member is elongated and has an upper part and a lower part, the lower part is bendable with respect to the upper part to adjust the lower portion of the back support cushion at the predetermined angular orientation relative to the upper portion of the back support cushion.

5. Apparatus as defined in claim 4, wherein the back support cushion further comprises:

an envelope cover surrounding the cushion, the envelope cover including a front cover piece adapted to contact the upper torso of the user and a rear cover piece contacting the back shell; and wherein:

the upper part of each stay member is retained in a pocket connected to the rear cover piece.

6. Apparatus as defined in claim 5, wherein the back support cushion further comprises:

a flexible contour platform located within the envelope cover adjacent to and in front of the rear cover piece and the stay member;

pelvic support wedges located within the envelope cover and connected to the contour platform at a position within the upper portion of the cushion, the pelvic support wedges adapted to induce support on tissue adjacent to iliac crests of the pelvic skeletal structure of the user when the user is seated on the seat support; and a layer of padding material located within the envelope cover in front of the contour platform and the pelvic support wedges and behind the front cover piece.

7. Apparatus as defined in claim 5, wherein:

the upper part of each stay member is retained within the upper portion of the cushion in a substantially immovable relationship to the back shell when the upper portion of the cushion is retained by the back shell.

8. Apparatus as defined in claim 1, wherein:

the back support cushion includes pelvic support wedges located within the upper portion of the back support cushion which are adapted to induce support on iliac crests of the pelvic skeletal structure of the user.

9. Apparatus as defined in claim 1, wherein:

the seating device is a wheelchair which has a frame that includes upright canes; and the back support orientation mechanism operatively connects the back shell to the canes.

10. Apparatus as defined in claim 1, wherein the back support orientation mechanism further comprises:

an attachment bracket connectable to the frame;

an attachment assembly connectable to the back shell; and an adjustment assembly operative between the attachment bracket and the attachment assembly to establish adjustable movement and retention of the attachment assembly relative to the attachment bracket in forward and backward directions, and in upward and downward directions, and in forward and backward pivotal directions, and wherein:

the adjustment assembly establishes the movement and retention in all of the forward and backward directions, in the upward and downward directions and in the forward and backward pivotal directions independently of any movement and retention in any of the other directions.

11. Apparatus as defined in claim 10, wherein the adjustment assembly comprises:

a pair of movement brackets connected to one another and between the attachment bracket and the attachment assembly and movable with respect to one another and the attachment bracket and the attachment assembly, the movement of one of the movement brackets moving the attachment assembly in the forward and backward directions with respect to the attachment bracket, and the movement of the other one of the movement brackets moving the attachment assembly in the upward and downward directions with respect to the attachment bracket, and the attachment assembly pivoting in the forward and backward pivotal directions relative to one of the movement brackets.

12. Apparatus as defined in claim 10, wherein the attachment assembly comprises:

a latch assembly which is operative to selectively connect the back shell to the adjustment assembly and to selectively disconnect the back shell from the adjustment assembly.

13. Apparatus as defined in claim 10, wherein the attachment assembly further comprises:

a back shell attachment bracket connectable to the back shell and including a pair of protruding attachment pins; and a latch assembly including a receiver body defining an opening for receiving the attachment pins, the latch assembly further including a latch receiver pivotally mounted within the receiver body to move between a first position in which at least one of the latch pins is retained within the opening and a second position in which the one latch pin is released for movement out of the opening.

14. Apparatus as defined in claim 13, wherein:

the latch receiver permits a predetermined range of pivoting movement of one latch pin relative to the other latch pin while the latch pins are retained within the opening in the first position.

15. Apparatus as defined in claim 14, wherein the attachment assembly further comprises:

an adjustable stop connected to the receiver body and operatively interacting with the latch receiver in the first position to limit and adjust the predetermined range of pivoting movement.

16. Apparatus as defined in claim 10, wherein the seating device is a wheelchair, the frame of the wheelchair comprises a cane, the attachment bracket is adapted to connect to the cane, and the attachment bracket further comprises:

a clamp body portion adapted to contact one side of the cane;

a hinged clamp arm pivotally connected to the clamp body portion to move the clamp arm toward the clamp body portion; and a retainer operative between the clamp body portion and the hinged clamp arm to hold the clamp arm pivoted against one side of the cane while the other side of the cane contacts the clamp body portion.

17. Apparatus as defined in claim 16, wherein the attachment bracket further comprises:

a contact member operatively connected to the clamp body portion to extend from the clamp body portion in an adjustable amount to contact the cane upon pivoting movement of the hinged clamp arm, the contact member spacing the cane from the clamp body portion while maintaining contact of the hinged clamp arm with the cane.

18. Apparatus as defined in claim 1, wherein:

each elongated stay member is defined by an upper part and a lower part;

the upper part of each stay member is retained within the upper portion of the cushion;

the lower part of each stay member is retained within the lower portion of the cushion;

the lower part of each stay member extends at an angle with respect to the upper part of the stay member; and the angle of the lower part of each stay member with respect to the upper part of each stay member adaptively retains the lower portion of the cushion in supportive contact with the gluteal and buttocks tissue of the user.

19. Apparatus as defined in claim 18, wherein:

the angle at which the lower part of the stay member extends with respect to the upper part of the stay member is approximately the same angular orientation at which the lower portion of the cushion extends with respect to the upper portion of the cushion.

20. Apparatus as defined in claim 18, wherein:

each stay member comprises bendable material; and the angle at which the lower part of the stay member extends with respect to the upper part of the stay member is established by a bend in the stay member between the upper and lower parts.

21. Apparatus as defined in claim 18, wherein:

the upper part of each stay member is retained against substantial movement within the upper portion of the cushion by support transferred from the back shell.

22. Apparatus as defined in claim 18, further comprising:

an envelope cover surrounding the cushion, the envelope cover including a front cover piece adapted to contact the upper torso of the user and a rear cover piece adapted to contact the back shell; and wherein:

the upper part of each stay member is retained in a pocket connected to the rear cover piece.

23. Apparatus as defined in claim 22, further comprising:

a flexible contour platform located within the envelope cover adjacent to and in front of the rear cover piece and the stay member;

pelvic support wedges located within the envelope cover and connected to the contour platform at a position within the upper portion of the cushion, the pelvic support wedges adapted to induce support on iliac crests of the pelvic skeletal structure of the user when the user is seated on the seat support; and a layer of padding material located within the envelope cover in front of the contour platform and the pelvic support wedges and behind the front cover piece.

24. Apparatus as defined in claim 18, wherein:

the upper part of each stay member is retained within the upper portion of the cushion in a substantially immovable relationship relative to the back shell when the upper portion of the cushion is retained by the back shell.

25. Apparatus as defined in claim 18, further comprising:

at least two stay members within the cushion; and a flexible contour platform extending within the upper and lower portions of the cushion, the portion of the contour platform extending within the lower portion of the cushion including a notch adaptively formed adjacent to a sacrum of the pelvic skeletal structure of the user when the user is seated on the seat support, the notch providing relief from pressure on the sacrum, one of the stay members contacting each portion of the contour platform on opposite lateral sides of the notch.

26. Apparatus as defined in claim 25, further comprising:

pelvic support wedges connected to the contour platform at a position within the upper portion of the cushion, the pelvic support wedges adapted to induce support on tissue adjacent to iliac crests of the pelvic support structure of the user; and an adjustable connection between the pelvic support wedges and the contour platform to permit adjusting the position of the pelvic support wedges on the contour platform while connecting the pelvic support wedges to the contour platform.

27. Apparatus as defined in claim 18, wherein the seating device is a wheelchair.

28. A method comprising:

using the apparatus defined in claim 1 to support the back support from the frame of the seating device with the back support contacting the upper torso of a user when the pelvic skeletal structure of the user is supported from the seat support located on the frame of the seating device with gluteal and buttocks tissue of the user located above a rear portion of the seat support by actions comprising:

supporting the upper torso of the user with the back shell and upper portion of the back support cushion;

supporting the posterior superior iliac spines of the pelvic skeletal structure of the user with a lower marginal area of the back shell adjacent to the lower edge of the back shell to maintain a desired alignment of the pelvic skeletal structure while the user is seated on the seat support;

pivoting the back shell about the pivot point to change the angular orientation of the back shell and the upper torso of the user without substantially changing the support on the posterior superior iliac spines from the lower marginal area of the back shell adjacent to the lower edge of the back shell;

positioning the lower edge of the back shell below a reference extending between the pivot point and posterior superior iliac spines and above a substantial majority of the gluteal and buttocks tissue of the user when seated on the seat support; and orienting the lower portion of the back support cushion at the predetermined angular orientation relative to the upper portion of the back support cushion retained by the back shell to contact and support the gluteal and buttocks tissue of the user below the posterior superior iliac spines.

29. A method as defined in claim 28, further comprising:

adjusting the predetermined angular orientation of the lower portion of the back support cushion relative to the upper portion of the back support cushion to establish supportive contact of the lower portion of the back support cushion with the gluteal and buttocks tissue.

30. A method as defined in claim 28, wherein the seating device is a wheelchair and the frame includes a cane of a wheelchair.

31. A method comprising:

using the apparatus defined in claim 1 to support the back shell from the frame of the seating device by actions comprising:

connecting an attachment bracket of the back support mechanism to the frame;

connecting an attachment assembly of the back support mechanism to the back shell;

adjusting the attachment assembly relative to the attachment bracket in each of forward and backward directions, upward and downward directions and forward and backward pivotal directions independently of any adjustment in any of the other two directions; and retaining the attachment assembly and the attachment bracket in a final predetermined position established from independently adjusted directions of the attachment assembly and the attachment bracket.

32. A method as defined in claim 31, wherein the seating device is a wheelchair and the frame includes a cane of the wheelchair.

33. An apparatus as defined in claim 1, wherein the back support cushion is formed by the actions comprising:

forming the upper portion of the back support cushion;

forming the lower portion of the back support cushion to extend from the upper portion; and extending each stay member between the upper and lower portions to orient the lower portion at the predetermined angular orientation relative to the upper portion.

34. An apparatus as defined in claim 33, wherein the seating device is a wheelchair.

35. A method comprising:

using the apparatus defined in claim 1 to fit the back support cushion to the upper torso of the user of the seating device without adversely affecting support for posterior superior iliac spines of the pelvic skeletal structure of the user when the user is seated on the seat support with gluteal and buttocks tissue located above a rear portion of the seat support by actions comprising:

attaching the back shell to the frame to pivot about the pivot point;

adjusting a vertical position of the back shell on the frame to position the lower edge of the back shell below a reference extending between the pivot point and the posterior superior iliac spines and above a substantial majority of the gluteal and buttocks tissue when the user is seated on the seat support;

adjusting the pivoted orientation of the back shell about the pivot point to extend the back shell at an angle for balancing the weight of the upper torso over the pelvic skeletal structure without inducing forces that push the pelvic skeletal structural forward or induce the upper torso to fall forward while maintaining support on the posterior superior iliac spines, independently of the pivoted orientation of the back shell;

temporarily attaching at least one elongated stay member to the back shell with the upper part of each stay member adjoining the back shell and the lower part extending below the lower edge of the back shell;

replicating with the temporary attachment of each stay member to the back shell a position of the upper part of each stay member within the back support cushion when the back support cushion is retained against the back shell;

adjusting an angle of the lower part of each stay member relative to the upper part of each stay member to align the lower part of each stay member at the predetermined angular orientation to contact and support the gluteal and buttocks tissue below the lower edge of the adjusted height back shell while the back shell extends at the adjusted pivot orientation and support is maintained on the posterior superior iliac spines, the lower part of each stay member angled relative to the upper part of each stay member to establish the predetermined angular orientation to support and confine the gluteal and buttocks tissue when the user is seated on the seat support;

disconnecting each temporarily attached stay member from the back shell;

assembling each disconnected stay member into the back support cushion to occupy substantially the same position in the assembled back support cushion relative to the back shell that each stay member occupied when temporarily attached to the back shell; and retaining the assembled back support cushion against the back shell.

36. A method as defined in claim 35, further comprising:

bending the lower part of each stay member extending below the lower edge of the back shell to establish the predetermined angular orientation.

37. A method as defined in claim 36, further comprising:

temporarily attaching a flexible contour platform relative to the back shell with the back shell adjusted to the pivoted orientation, the temporary attachment of the contour platform replicating a position of the contour platform relative to each stay member within the assembled back support cushion when the back support cushion is retained against the back shell.

38. A method as defined in claim 37, further comprising:

temporarily attaching each stay member to the back shell and temporarily attaching the contour platform relative to the back shell with hook and loop material.

39. A method as defined in claim 37, further comprising:

disconnecting the temporarily attached contour platform before disconnecting each temporarily attached stay member; and assembling the disconnected contour platform into the back support cushion to occupy substantially the same position within the assembled back support cushion that the contour platform occupied when temporarily attached relative to the back shell.

40. A method as defined in claim 39, further comprising:

attaching pelvic support wedges to the temporarily attached contour platform at positions adjacent to the back shell to provide support for iliac crests of the pelvic skeletal structure of the user when the user is seated on the seat support;

disconnecting the temporarily attached contour platform after the pelvic support wedges have been attached to the contour platform; and assembling the disconnected contour platform with the attached pelvic support wedges into the back support cushion to occupy substantially the same positions that the contour platform and pelvic support wedges occupied when the contour platform was temporarily attached relative to the back shell.

41. A method as defined in claim 40, further comprising:

temporarily attaching the pelvic support wedges to the temporarily attached contour platform to evaluate the placement of the pelvic support wedges relative to the iliac crests of the pelvic skeletal structure of the user; and maintaining the attached position of the pelvic support wedges to the contour platform upon obtaining a desired placement of the pelvic support wedges.

42. A method as defined in claim 40, further comprising:

confining components of the back support cushion within an envelope cover of the back support cushion; and assembling each disconnected stay member into the back support cushion by inserting each stay member into a pocket formed in the envelope cover to confine each stay member at a location which replicates the position of that stay member when temporarily attached to the back shell.

43. A method as defined in claim 42, further comprising:

assembling the contour platform and the attached pelvic support wedges into the back support cushion by placing the contour platform adjacent to each stay member within the envelope cover.

44. A method as defined in claim 43, further comprising:

inserting a layer of padding material adjacent to the contour platform within the envelope cover.

45. A method as defined in claim 37, wherein the seating device is a wheelchair and the frame includes canes.

* * * * *